US008122924B2

(12) United States Patent
Koch et al.

(10) Patent No.: US 8,122,924 B2
(45) Date of Patent: Feb. 28, 2012

(54) COUPLING CLOSURES AND DOCKING DEVICES COMPRISING SAID COUPLING CLOSURES

(75) Inventors: Martin Koch, Neuenburg-Grißheim (DE); Joachim Stoyle, Neuenburg-Grißheim (DE); Stefan Vogler, Aachen (DE)

(73) Assignee: Gea Pharma Systems AG, Bubendorf (CH)

( * ) Notice: Subject to any disclaimer, the term of this patent is extended or adjusted under 35 U.S.C. 154(b) by 1354 days.

(21) Appl. No.: 10/566,017

(22) PCT Filed: Jul. 30, 2004

(86) PCT No.: PCT/DE2004/001720

§ 371 (c)(1),
(2), (4) Date: Apr. 6, 2007

(87) PCT Pub. No.: WO2005/012089

PCT Pub. Date: Feb. 10, 2005

(65) Prior Publication Data

US 2007/0277478 A1 Dec. 6, 2007

(30) Foreign Application Priority Data

Aug. 1, 2003 (DE) ..... 103 35 325

(51) Int. Cl.
*B65B 1/04* (2006.01)

(52) U.S. Cl. ..... 141/383; 141/114; 141/313; 383/37; 383/80; 285/227; 285/235

(58) Field of Classification Search ..... 141/10, 141/114, 313, 314, 382, 383; 383/37, 61.3, 383/78, 80, 87; 285/227, 229, 235
See application file for complete search history.

(56) References Cited

U.S. PATENT DOCUMENTS

| | | | | |
|---|---|---|---|---|
| 2,653,744 | A * | 9/1953 | Behr | 141/10 |
| 3,826,292 | A * | 7/1974 | Lerche-Svendsen | 141/114 |
| 5,853,207 | A | 12/1998 | Saint Martin et al. | |
| 6,604,519 | B1 | 8/2003 | Bosser | |
| 2005/0084181 | A1 | 4/2005 | Koch et al. | |

FOREIGN PATENT DOCUMENTS

| | | |
|---|---|---|
| DE | 43 29 276 | 3/1995 |
| DE | 196 24 189 | 1/1998 |
| DE | 695 04 581 | 4/1999 |
| DE | 201 17 669 | 4/2002 |
| DE | 697 18 439 | 7/2003 |
| EP | 0 554 096 | 8/1993 |
| EP | 1 112 011 | 6/2003 |

* cited by examiner

*Primary Examiner* — Gregory Huson
*Assistant Examiner* — Jason Niesz
(74) *Attorney, Agent, or Firm* — Schiff Hardin LLP

(57) ABSTRACT

A coupling closure is provided for substantially environmentally-sealed reversible closure of containers or hose elements. At least one first flexible band with at least one first closure element is provided. At least one second flexible band is provided with at least one second closure element that is complementary to the first closure element. A top side of the first band comprises at least one third closure element and a top side of the second band comprises at least one fourth closure element. Also a coupling closure is provided for substantially environmentally-sealed reversible closure of containers or hose elements comprising a plurality of frame bands and articulation devices. Immediately adjacent frame bands are connected with one another via at least one articulation device between the immediately adjacent frame bands to form a circumferential folding frame wherein inner sides of at least two adjacent or opposing frame bands are foldable one on top the other to form a closure.

16 Claims, 12 Drawing Sheets

COUPLING CLOSURES AND DOCKING DEVICES COMPRISING SAID COUPLING CLOSURES

BACKGROUND

The present preferred embodiment concerns coupling closures as well as docking devices comprising these coupling closures. The preferred embodiment also concerns a flexible container and a hose comprising the coupling closures, the use of the docking devices for environmentally-sealed filling, refilling and emptying of containers as well as a method for environmentally-sealed filling, refilling and emptying of containers. The preferred embodiment moreover concerns a method for manufacture of a coupling closure.

Fluid or solid bulk materials accumulate as interim or end products in manifold methods, and, insofar as they are not supplied to their intended location or final destination via pipeline systems, an advantageous embodiment to be transported and placed in circulation in the form of packing drums of a specific size. Since some products already act on the human organism in a highly toxic manner in small quantities or react highly sensitively with air or moisture, very high requirements for environmental sealing are to be set given the refilling of such products, for example for the purpose of further processing into interim or end products. In addition to avoiding the contamination of the environment, high requirements are regularly also set with regard to the purity of the initial or interim products used, particularly in the further-processing industry, for which reason contamination due to external impurities must be avoided at every point of the method workflow and not only in the manufacture and isolation of the initial products. The risk of contamination of the environment or of products is particularly high specifically in the refilling procedure, which is why these work steps are frequently conducted under super-clean room conditions (for example in the pharmaceutical industry). The necessity of working in a contamination-free environment leads to a high machine and safety-related expenditure (particularly in the food processing, chemical or pharmaceutical industries) that inevitably negatively affects manufacturing costs.

The double flap technique as it is described in DE 695 04 581 T2 is frequently resorted to nowadays for the environmentally-sealed or at least dust-free filling or emptying of a container as well as for refilling procedures. Such docking devices according to the double flap technique are very complicated in terms of design and are thus regularly also cost-intensive.

According to DE 196 24 189 A1, docking devices of a simpler design can also be formed from a first docking element (which is designed funnel-shaped) and a second docking element which is connected to the funnel-shaped docking element positive fit, in particular forming a spherical contact area. To ensure the gas impermeability, the contact area has to possess a rubber elastic surface. Although a refilling flowing media with the docking device described in DE 196 24 189 AI works, it cannot be guaranteed that these flowing media do not enter the environment upon coupling or decoupling the docking elements.

PCT/EP01112011 describes a sealed docking device between two essentially environmentally-isolated containers that are connected via two elastically-deformable coupling elements. These coupling elements respectively possess one slit, which is closed in the ground state and which can be opened via admission of pressure. The containers to be filled or to be emptied are to be attached in the area of the slit or on the walls of the slit of the respective coupling element. Given this design docking device, particular care is to be taken to ensure that the slits of the coupling elements adjacent to one other are of equal length and come to lie precisely one atop the other.

In the unpublished German patent application with the reference number 103 21 814.9, a coupling element for the environmentally-insulated refilling, filling and/or emptying of containers is disclosed which is essentially comprised of two closure bands fitting flush with each other that possess interlocking articulation bodies at their end and which can be rotated around common bearing axis elements. The articulation axis elements or articulation caps have to be exactly matched to the shape and size bearing elements of the closure bands in order to be able to durably and reliably function as pivot bearings. Given this construction, under specific refilling conditions (for example dependent on the type of bulk material) it is to be attended to that no bulk material remains between the terminal sections of the opposing closure bands. An opening and closing of this coupling element is achieved in that the opposing articulation bodies are moved towards one another or away from one another. Only a limited opening angle can hereby be achieved due to design.

A sealed docking device between two essentially environmentally-isolated containers is to be learned from DE 201 17 669 U1, whereby each container can be connected at least in regions with a coupling element in an essentially flexible as well as sealed manner. These coupling elements, which respectively possess a transit slit, are arranged one atop the other such that, given elastic deformation of the coupling elements fitted in a sealed manner one atop the other, a transit gap for fluids is achieved. These coupling elements can respectively be provided with guidance devices on opposite side surfaces, which guidance devices engage with one another in a complementary manner.

DE 697 18 439 D2 discloses a re-sealable fastening arrangement with fastening strips that can be placed on one another, which fastening strips respectively exhibit a plurality of closure elements along the length of their inner surfaces, which closure elements can be brought into engagement with one another. DE 697 18 439 D2 is in particular intended to make available a slider for the fastening arrangement that can be moved along the fastening strips and covers these between a closed position and an open position and exhibits an upper closure surface as well as side walls that extend down from the opposite sides of the upper closure surface and take in the fastening strips between them. In order to make a simplified slider available in which the probability of leakage loss of fluids through the closure remains optimally low, the side walls of the slider have to extend from the upper closure surface down to a point under the profiles in the manner that the profiles are maintained between the side walls, and whereby a separator element has to exist in the form of a blade.

It would thus be desirable to be able resort to coupling elements and docking devices which guarantee an environmentally-sealed filling or refilling given both small and large packing drums. It would also be desirable to be able to reduce the risk of contamination even further given filling or emptying or given coupling or decoupling of coupling elements, particularly also with structurally simple, less cost-intensive solutions.

SUMMARY

A coupling closure is provided for substantially environmentally-sealed reversible closure of containers or hose elements. At least one first flexible band with at least one first closure element is provided. At least one second flexible band is provided with at least one second closure element that is complementary to the first closure element. A top side of the first band comprises at least one third closure element and a top side of the second band comprises at least one fourth closure element. Also a coupling closure is provided for substantially environmentally-sealed reversible closure of containers or hose elements comprising a plurality of frame bands and articulation devices. Immediately adjacent frame bands are connected with one another via at least one articulation device between the immediately adjacent frame bands to form a circumferential folding frame wherein inner sides of at least two adjacent or opposing frame bands are foldable one on top the other to form a closure.

DESCRIPTION OF THE PREFERRED EMBODIMENT

Figure 1:
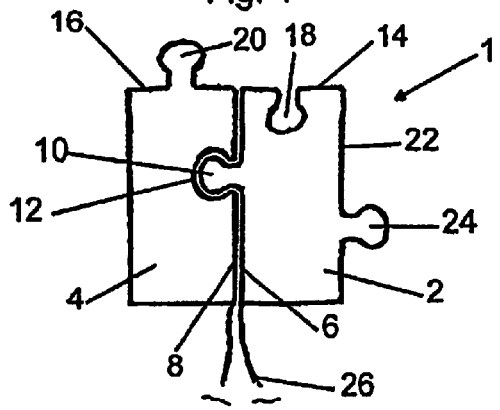
FIG. 1 is a schematic cross-section profile view of a first coupling closure.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

The present preferred embodiment was therefore based on the object to overcome the disadvantages of the prior art and in particular to provide coupling devices and docking devices with which large as well as very large packing drums can be filled and refilled in an unproblematic and environmentally-sealed manner, whereby restrictions on the fluid flow are placed neither by a small aperture angle nor small aperture surfaces. The present preferred embodiment was furthermore based on an object to make available coupling devices and docking devices that can be assembled from optimally few components and are also to be handled advantageously from ergonomic points of view. The present preferred embodiment was also based on the object to make accessible coupling devices and docking devices that, independent of the complexity of the components used and the design expenditure, ensure a very high degree of impermeability relative to the environment, such that the danger of the contamination of the environment can be completely or, respectively, nearly completely eliminated.

A first further development of a coupling closure for essentially environmentally-sealed, reversible closure of (in particular flexible) containers or hose elements as well as for essentially environmentally-sealed filling and/or refilling of bulk material from (in particular flexible) containers or hose elements was accordingly found, which further development of a coupling closure comprises: at least one first flexible band with at least one first (in particular continuous) closure element (in particular a tongue) on its inner side; and at least one second flexible band with at least one first (in particular continuous) closure element (in particular a groove) on its inner side that is complementary to the first closure element and enables a reversible, tight closure with this; whereby the first and second band and/or the first and second closure element are in particular essentially the same length; whereby the first and second bands are connected with one another (in particular via their respective end segments), in particular under formation of a closed perimeter; and whereby the top of the first band comprises at least one third (in particular continuous) closure element and/or the top of the second band comprises at least one fourth (in particular continuous) closure element.

For example, the coupling closure of the preferred embodiment can be a component of a plastic bag and be present in the region of the circumferential opening edge of the same. The second band thereby advantageously attaches itself to the end of the first band, whereby likewise both remaining ends or end segments of first band and second band are directly connected with one another. In that not only the inner sides of the first band and second band exhibit closure elements corresponding to one another, but rather likewise their tops are equipped with closure elements that enable an environmentally-sealed coupling to a second inventive coupling closure, an environmentally-sealed filling and/or refilling of bulk material can also be ensured given very flexible bag and/or band materials.

Coupling closures in the sense of the present preferred embodiment are designed to take on at least one dual function. On the one hand, they represent a closure means that can be brought from an opened position into a closed position or vice-versa. On the other hand, these coupling closures are designed and suited to be coupled with corresponding coupling closures to form a docking device, in particular in an environmentally-sealed manner. For example, the corresponding coupling closure can hereby possess an identical or mirror-image design in relation to the coupling closure to be coupled. Alternatively, the coupling closures to be coupled can deviate from one another in terms of their design and/or their technical characteristics, however not to a degree that would no longer allow coupling or decoupling. In general, these coupling closures can be coupled with one another to form a docking device and then also decoupled again in both an open and also a closed state. These coupling closures can also be designed such that, when they have respectively been coupled in a closed state, they can be opened in sequence or, advantageously, simultaneously. Coupling closures in the sense of the present preferred embodiment are suitably present at the openings of containers, packing drums or transport means unit such as hoses and are connected with these, in particular in a sealed manner. Via actuation of the coupling closure the container, packing drum or the transport unit can thus be opened or closed as well as be coupled with a container, packing drum or transport unit that is equipped with a corresponding coupling closure to form a docking device.

A preferred coupling closure also possesses a closure cover comprising at least one seventh and/or eighth closure element that is, or are complementary to the third and/or fourth closure elements of the top of the first and/or second band, whereby the seventh and eighth closure elements can be connected with the third and/or fourth closure elements to form a temporary covering of the connection slit from first band and second band when the inner sides of first band and second band exist connected with one another via an interaction of first closure element and second closure element.

In particular when bulk material containers are to be transported or to be stored over a long period of time, it has proven to be advantageous to seal or to cover from the environment the connection slit of first and second bands fitted to one another. In this manner it is prevented that the tops of the coupling closure are contaminated with dust or other particles.

In an appropriate further development, the coupling closure likewise possesses at least one fifth and/or sixth closure element on at least one outer side of first band and/or second band. In the case of the docking of two preferred embodiment coupling closures, these fifth and sixth closure elements on the outside of a band can be drawn upon in order to enter into a temporary connection with a closure cover that possesses corresponding seventh and eighth closure elements.

It has thereby turned out to be advantageous when the closure cover (in particular one piece) is connected with the first or second band (in particular by means of at least one film hinge.

In order to simplify the handling of the preferred embodiment coupling closures and to design them as reliable, it is advantageous when the closure cover comprises at least one control grip.

For this it hereby contributes in the same manner that the first and/or second band exhibits or exhibit at least one control grip on the outside.

The preferred embodiment coupling closure is in particular suited for the filling and/or refilling of bulk material from flexible containers, for example plastic bags or sacks. In one embodiment, such a coupling closure accordingly possesses a flexible bag or hose whose opening edge is connected separately or in one piece with the first band and second band. The coupling closure can thus be both an integral component of a flexible bag (in particular in the region of the opening edge of this bag) and be reversibly or irreversibly connected with the bag after the event.

The danger of contaminations can preferably also be further reduced in that at least the inner side and/or the top of the first band and/or second band exhibits or exhibit a bonding and/or adhesive layer at least in sections.

An object forming the basis of the preferred embodiment, at least with regard to the environmentally-sealed refilling of bulk material, is also achieved via a preferred embodiment docking device according to the first further development comprising a first and a second coupling closure according to the first further development, whereby the first band and the second band of the first coupling closure and the first band and the second band of the second coupling closure are in particular essentially equal in length, and whereby the third and fourth closure elements of the tops of first band and second band of the first coupling closure are respectively complementary to the third and fourth closure elements of the tops of first band and second band of the second coupling closure, such that the first and second bands of first and second coupling closure can be reversibly connected with one another, in particular in an environmentally-sealed manner.

Both first and second coupling closures according to the first further development that are to be connected with one another are dimensioned essentially identically in order to enable an environmentally-sealed coupling. A particular advantage of the docking device also exists in that two identical coupling closures can be used. For this it is already sufficient when the third and fourth closure elements of first band and second band of the first coupling closure are designed complementary to one another. For example, the third closure element on the top of the first band can represent a tongue and the fourth closure element on the top of the second band can represent a groove complementary to this. Given an essentially identical dimensioning or length of the coupling closures to be coupled, these can then be connected with one another in an environmentally-sealed manner. The manufacturing and storage costs for the inventive docking devices can be considerably reduced in this manner.

A preferred embodiment of a docking device according to this further development also possesses at least one fifth and/or sixth closure element on at least one outer side of first and/or second band of first and/or second coupling closure that is or are complementary to the seventh and/or eighth closure elements of the closure cover or closure covers of first and/or second coupling closure. The handling safety in the refilling process is considerably increased even when only one coupling closure is provided with one closure cover that possesses seventh and/or eighth closure elements that can engage in fifth and/or sixth closure elements attached on the outside of one band. An even higher degree of environmental impermeability and safety is achieved via corresponding use of a second closure cover that is present on the second coupling closure.

It can accordingly be provided that the closure cover of the first coupling closure can be or is reversibly connected with at least one seventh and/or eighth closure element of the second coupling closure and that the closure cover of the second coupling closure can be or is reversibly connected with at least one seventh and/or eighth closure element of the first coupling closure when the third and fourth closure elements of first coupling closure and second coupling closure are present connected with one another.

According to a further aspect of the present preferred embodiment, the aforementioned docking devices according to the first further development are already or can already be connected via their first and second coupling closures with at least one flexible container, hose or hose element.

An object forming the basis of the present preferred embodiment is also achieved via a second further development of a coupling closure for essentially environmentally-sealed, reversible sealing; and/or for essentially environmentally-sealed filling and/or refilling of bulk material from (in particular flexible) containers, hoses or hose elements comprising, in particular, essentially rigid frame bands and articulation devices; whereby immediately adjacent frame bands are respectively connected with one another via at least one articulation device between these frame bands to form a circumferential folding frame; such that the inner sides of at least two adjacent and/or opposite frame bands can be hinged to one another to form an (in particular) environmentally-sealed closure.

It can thereby be provided that the folding frame comprises x frame bands and x articulation devices, whereby in particular $x=2 \cdot n$ and n is a natural number greater than or equal to 2. Naturally, folding frames with (for example) five frame bands and five articulation devices also fulfill the preferred embodiment purpose.

Such coupling closures whose folding frames are comprised of four frame bands and four articulation devices to form what is known as a parallelogram closure have proven to be particularly advantageous.

Such coupling closures according to the second further development, whose folding frames possess six or eight frame bands and advantageously six or, respectively, eight articulation devices are also particularly suited.

In that respective adjacent frame bands are connected with one another via one articulation device, the inner sides of these frame bands can fold with one another to form a closure slit.

The mobility and affixing of adjacent frame bands works, for example, via articulation devices in the form of hinges, film hinges and/or elastic materials. The use of film hinges has hereby proven to be particularly suitable. These can, for example, connect adjacent frame bands with one another over their entire width, in particular in an environmentally-sealed manner. Such film hinges can be produced from a rubber-elastic material (for example a thermoplastic elastomer), advantageously by means of the two-component injection molding technique. In this manner, one obtains a one-piece folding frame or, respectively, a one-piece coupling closure according to the second further development that is also absolutely environmentally-sealed in the region of the transitions from frame bands to articulation device or, respectively, film hinge.

Such coupling closures according to the second further development have proven to be very particularly preferable, in which coupling closures the folding frame comprises six frame bands and six articulation devices with a first pair of adjacent frame bands connected with one another via one articulation device and in particular essentially equal in length; with a second pair of adjacent frame bands connected with one another via one articulation device and in particular essentially equal in length; and with a third pair of frame bands that are not adjacent and/or are not directly connected with one another via one articulation device and are in particular essentially equal in length; whereby the sum of the length of one frame band of the first pair and the length of one frame band of the second pair is not greater than the length of one frame band of the third pair of frame bands.

Such embodiments are hereby of particular advantage in which the inner side of the first frame band of the first pair and the inner side of the first frame band of the second pair can both be turned towards the inner side of the first frame band of the third pair, and the inner side of the second frame band of the first pair and the inner side of the second frame band of the second pair can both be turned towards the inner side of the second frame band of the third pair to form a sealed closure slit.

A particular degree of impermeability can in particular be achieved in that the folding frame, in the region of at least one of its circumferential edges, comprises an essentially circumferential sealing lip extending inwards and/or over the edge.

Coupling closures according to the second embodiment are also characterized by at least one spacer on the outer side of the first and/or the second frame band of the first and/or the second pair of frame bands that is arranged closer to the common articulation device(s) with the frame band(s) of the third pair of frame bands than to the articulation device(s) which connect the frame bands of the same pair of frame bands.

These spacers lead to the outer sides of the frame bands of the first and/or the second pair, which are opposite each other in a closed state, being separated further from one another in the area of the articulation connections with the frame bands of the third pair, for example in a range of 0.5 to 5 mm, than given the articulation device that connects the frame bands of a common pair. An even tighter closure slit is ensured in this manner.

Moreover, such folding frames are preferably resorted to in which the frame bands and the articulation devices connecting these frame bands are comprised of the same material, whereby the material strength or thickness in the region of the articulation devices is selected thin such that a destruction-free reversible movement is ensured. On the other hand, the strength or thickness of the material in the region of the frame bands is set in the manner that essentially rigid frame bands result. Suitable materials advantageously comprise synthetic materials such as polyamide, polyoxylalkylene, in particular polyoxymethylene (POM), PVC, polyketone, in particular aliphatic alternating polyketone, its impact-resistant modified variants, as well as any mixtures of the cited synthetic materials. Folding frames in which the frame bands and articulation elements are comprised of the same material are advantageously produced in one piece.

A particularly high degree of environment impermeability can also be achieved when the inner sides of the frame bands comprise (at least in sections) first and second closure rails for environmentally-sealed closure, which inner sides are in particular complementary and/or elastomeric or made of springy elastic material; whereby the total length of the first closure rail essentially corresponds to the total length of the second closure rail; and whereby the first and second closure rails or their sections are arranged on the inner sides of the frame bands such that they form an environmentally-sealed closure slit (in particular interlocking with one another) given frame bands folded one atop the other. As a result, first and second closure rails can also be formed identically in one embodiment.

Closure rails complementary to one another are advantageously designed and arranged such that they interlock with one another, automatically and without further measures, upon folding together the folding frame.

It is thereby advantageous when first and/or second closure rails also extend to the inner sides of the articulation devices and/or are present or can be attached on these.

It can thereby be provided that the first closure rail represents a groove and the second closure rail represents a tongue complementary to the groove. Naturally, a closure rail can also comprise and groove/tongue combination.

In particular given use of film hinges that are incorporated (by means of the two-component injection molding technique) into the coupling closure according to the second further development, closure rail sections can also already be provided with these film hinges on the inner side in the production. Naturally, two or more closure rails can also be attached or exist together, one under the other (for example in parallel) on the inner side of frame bands and film hinges, whereby the degree of environmental impermeability can be increased again. With such designed, coupling closures according to the second further development, a very environmentally-sealed closure slit already necessarily arises due to the type of the handling upon closing of the same.

It can accordingly be provided, for example, that at least one first closure rail is present at least in sections on the inner side of adjacent first and second frame bands and at least one second closure rail is positioned at least in sections on the inner sides of adjacent third and fourth frame bands.

In principle, the attachment of the corresponding closure rails can be arbitrary; however, it has proven to be advantageous when a second closure rail complementary to the first closure rail and of equal length is connected to a first closure rail, whereby both closure rails extend over the entire circumference of the folding frame. Naturally, first and second closure rails can also be distributed in sections over the inner circumference of the folding frame as long as an interlocking among one another of sections complementary to one another is ensured upon closing.

As an alternative or in addition to the described closure rails, the folding frame can comprise an advantageously circumferential sealing lip in the area of its circumferential edge or its circumferential border. This sealing lip advantageously takes on at least a double function. In one embodiment, it is thus attached at, on and/or in the area of the edges of the frame bands forming the folding frame such that said sealing lip is essentially circumferential and extends at least slightly in the direction of the interior of the opening area spanning the folding frame. If the inner sides of adjacent or opposite frame bands of the folding frame are then guided or placed against one other, the sealing lips (pointing inwards at least partially) touch each other or are pressed against each other and form a sealed closure slit. In a second embodiment, the preferably circumferential sealing lip extends at least slightly over the edge of the folding frame and/or rests on this. In this manner it is ensured that, an environmentally-sealed docking device is obtained when two coupling closures according to the second further development are coupled with one another that advantageously both possess sealing lips extending over the edge and/or resting on this. It can thus be ensured that a sealed, coupled system results at least temporarily via pressing the sealing lip of one coupling closure of the second further development onto the folding frame or, respectively, the sealing lip of the corresponding coupling closure according to the second further development. Synthetic or natural rubber or thermoplastic elastomers are advantageously resorted to as sealing lip material.

The handling of the coupling closure according to the second further development can be improved again by at least two control grips which in particular can be attached or are present on non-adjacent frame bands.

In this context, such embodiments are of particular advantage in which at least one control grip possesses at least one centering and/or arresting unit for the interaction with a corresponding coupling closure (in particular its centering and arresting unit) to form a docking device.

It can also be provided that at least the folding frame is designed as a single piece.

The coupling closures according to the second further development are furthermore characterized in that at least one, in particular all frame bands comprise (at least in sections) at least one first closure element on the top, which closure element is in particular elastomeric or made of springy elastic material.

It can thereby be provided that the first closure element represents a (in particular continuous) groove and/or a tongue.

In that the top sides of the frame bands are provided at least in sections with a closure element, care is taken that two coupling closures according to the second further development can be connected with each other in a particularly environmentally-sealed manner to form a docking device.

Handling safety can be increased again in that the coupling closure according to the second further development possesses at least one second closure element on the outer side of at least one frame band or an extension of the same. For example, it can hereby be an outlet, an extension, a groove or a tongue. Such second closure elements can also be drawn upon in order to particularly securely arrest a closure cover.

A coupling closure according to the second further development accordingly possesses at least one closure cover with at least one third closure element that is essentially complementary to the closure element, and/or with at least one fourth closure element that is essentially complementary to the second closure element, such that the closure cover covers the closure slit of the folding frame at least in sections given a closed coupling closure.

It can thereby be provided that the closure cover is connected, at least in sections, with a frame band via a hinge, a film hinge or a flexible connecting element.

The handling and transport capability of this coupling closure can be increased in that the closure cover is provided with at least one control and/or transport grip.

The coupling closures according to the second further development can also possess a flexible container or a flexible hose or a flexible hose element that is connected sealed with the frame bands and/or the articulation devices.

Naturally, these coupling closures can be connected reversibly and irreversibly with a hose or a flexible bag.

To reduce the degree of contamination upon filling or refilling of bulk materials, it can also be provided that at least the inner side and/or the top side of at least one frame band comprise or comprise, at least in sections, a bonding and/or adhesive layer.

A particularly preferred coupling closure according to the second further development is also characterized by at least one first arresting element present on the inner side of at least one frame band and by at least one first arresting opening or first locking element in one inner side of at least one frame band, whereby the first arresting element can be locked in the first arresting opening (in particular in a reversible manner) upon closing the folding frame.

Via use of (for example) retention pins on the inner sides of the frame bands that are arranged such that they can lock in corresponding arresting openings or locking elements, it is ensured that the closure attained once is not released again without the external expenditure of force. Moreover, dependent on the dimension of the length of the arresting element, this inlying locking mechanism it is effected that the complementary closure rails present on the inner sides of the frame bands are pressed against each other, which contributes to particularly pronounced secure environmental impermeability. By arresting openings, what are to be understood as existing, for example both apertures through the wall of the frame bands, and omissions, thus concavities or indentations in the inner wall of the frame bands which do not lead to an opening. No loss of environmental impermeability is consequently entailed with such an arresting measure. Naturally, given use of arresting holes the arresting elements or rods can also be shaped such that, as soon as they engage in the holes, they seal these completely and in an environmentally-sealed manner. For example, given a parallelogram closure a plurality of retaining pins can be present on two adjacent sides, and whereby the remaining two sides are provided with corresponding arresting omissions or locking elements. These arresting pins and openings or omissions and locking elements are to be attached such that they essentially interlock with a precise fit upon folding of the frame bands one atop the other.

Furthermore, the coupling closures according to the second further development are also characterized by at least one handhold on the outer side of at least two (in particular opposite) frame bands, in particular in the region of or below the transition from the outer side to the upper side of a frame band.

It is hereby of particular advantage when the handhold comprises at least one retention rail (attached on the outer side of a frame band) containing at least one second arresting opening, at least one first handle element (in particular a first handle plate), at least one second handle element (in particular at least one second handle plate) as well as at least one first and at least one second film hinge; whereby the first handle element is connected with the retention rail via the first film hinge and the second handle element is connected with the first handle element via the second film hinge; and whereby the second handle element, in particular in the edge region, possesses at least one second arresting element that corresponds to the second arresting opening; and whereby second handle element can be folded on the first handle element and the second arresting element can be engaged (in particular reversibly) in the second arresting opening.

According to a further embodiment, it is suggested that given at least one articulation, in particular with two opposing or not directly adjacent articulations, adjacent frame bands and/or their extension in the articulation form (at least in sections) an angle at least in the articulation in cross-section, in particular an acute or right angle.

It can thereby be provided that at least one notch, in particular essentially parallel to the articulation rotation axis, is present at least along a section on the inner side of at least one articulation, in particular on the inner sides of opposite articulations. By notch, what should be understood in the sense of the present preferred embodiment is such a constructive measure that enables adjacent frame bands emanating from this articulation to be placed one atop the other, in particular without an opening remaining in the articulation region. Due to the notch, the articulation acts as a folding hinge with an essentially narrowly localized, fixed rotation point at the turning point of the notch. In this way, not only do the inner sides of the frame bands which are folded one atop the other rest flush with one another, but rather also the articulation sections extending these frame bands up to the actual rotation point, which articulation sections meet at this rotation point.

The coupling closures according to the second embodiment can, for example, be attained in that the coupling closure is produced by means of injection molding, in particular by means of the two-component injection molding technique, whereby a rubber-elastic material or a thermoplastic elastomer are used for the articulation elements and a thermoplastic and/or a duroplastic material are used for the frame bands.

It can hereby be provided that this method is conducted with a single injection mold form, in particular in one stage, or with at least two injection mold forms, in particular in two or more stages.

It is also suggested that the articulation or articulations are sprued on adjacent frame bands, or that one or more frame bands are sprued onto adjacent articulation devices.

According to an alternative method of production, the frame bands can also be connected with the articulations by means of adhesion or fusing. It has emerged as particularly advantageous to connect frame bands and articulations with one another by means of an injection molding technique. Suitable glues as well as fusing and spruing techniques are familiar to the average man skilled in the art.

The object forming the basis of the preferred embodiment is also achieved via a further docking device according to a second further development for (in particular environmentally-sealed) filling and/or refilling of bulk material comprising a first and a second inventive coupling closure according to the second further development; whereby the first and second coupling closures significantly coincide in number, length and arrangement of their frame bands, such that first and second folding frames that can be connected with one another result; and whereby in particular the first closure element of the top of the frame bands of the first coupling closure is complementary to the first closure element of the top of the bands of the second coupling closure, such that first and second coupling closures can be reversibly connected (in particular in an environmentally-sealed manner).

Sealed docking devices are particularly characterized in that the first folding frame comprises an in particular circumferential sealing lip that fits or can be fitted sealed to the edge and/or onto the sealing lip of the second folding frame.

Docking devices according to the second further development are also characterized by at least one second closure element on the outer side of at least one frame band of the first and/or the second coupling closure that is complementary to the fourth closure element of the closure cover.

In a further embodiment, such docking devices according to the second further development possess a flexible container and/or a hose or a hose element that is essentially connected environmentally-sealed with the first and/or second coupling closure.

For particularly environmentally-sealed sample extraction, flexible containers can also be provided with at least one extraction device, in particular in the form of a spoon or spatula that is connected with the flexible container on its inside.

An object forming the basis of the preferred embodiment is achieved with regard to a method for (in particular environmentally-sealed) filling, refilling and/or emptying of flexible containers with bulk material in that a) a first flexible container is connected with a stationary or transportable second flexible container or with a tube via the respective environmentally-sealed first and second coupling closures according to a first or second further development to form a docking device according to the first or second further development, b) these first and second coupling closures are opened while maintaining an environmentally-sealed docking device, c) the bulk material is transported from the first container into the second container or vice versa or through the hose into the first or second container, d) these first and second coupling closures are closed in an environmentally-sealed manner while maintaining an environmentally-sealed docking device, and e) these coupling closures of the first container and second container are separated from one another under decoupling of the docking device, in particular an environmentally-sealed manner.

Given the embodiment of the coupling closure according to the second further development as shown in the preceding, it is of particular advantage that a particularly reliable and failure-insusceptible closure and refill variant has been found via use of a folding frame. Sealing rails that are complementary to one another can be brought to engage with one another solely through the shifting of adjacent frame bands against one another. In particular relative to coupling closures or elements known from the prior art, it is likewise of particular advantage that adjacent frame bands can also be opened far removed from one another, whereby it is prevented that bulk material residues (for example in acute-angled niches) remain behind upon refilling and subsequently contribute to the contamination of the environment. Additionally, consequently no additional suction devices must also be provided in the region of the articulation devices.

The present preferred embodiment with regard to the coupling closures according to the first further development and second further development is thus based on the surprising realization that both coupling element with flexible closure bands and coupling elements with rigid closure bands are suitable for environmentally-sealed filling and refilling of bulk material from or into flexible containers without having to take limitations into account with regard to the packing drum sizes or the opening area. The coupling closures are accordingly suitable for all packing drum sizes and can be reliably connected without great effort with coupling closures of the respective same design for environmentally-sealed docking devices. Furthermore, the coupling closures and docking devices according to the first further development and second docking device are characterized by a very small number of components and can accordingly be manufactured and assembled in a cost-effective manner. In this context, not just the manufacturing process but rather likewise the maintenance of the coupling closures and docking devices prove to be less work-intensive and time-consuming. It shows as a particular advantage of the coupling closures and docking devices that these must neither be kept in an opened state nor in a closed state under pre-tension, whereby (for example) upon opening no resistance innate to the component is to be overcome. This precludes a fast material fatigue and ensures a durably reliable handling with a durably high degree of environmental impermeability.

FIG. 1 shows a first development of a coupling closure 1 in schematic cross-section view in a closed state. The first band 2 and the second band 2 of the coupling closure 1 lie closely fitted to one another via their inner sides 6 and 8 to seal the flexible bag 26. The first closure element 10 located on the inner side 6 of the first band, which first closure element 10 is designed in the form of a tongue, thereby engages in the second closure element 12 present on the inner side 8 of the second band 4, which second closure element 12 is designed in the form of a groove. The first and second closure elements 10 and 12 can be arbitrarily designed as long as they behave in a complementary manner in shape and size and ensure that the first and second bands 2 and 4 do not detach from one another without external force effect. Suitable clip, groove or rivet closures are known to the average man skilled in the art. The first and second closure elements 10 and 12 extend in an advantageous manner along the entire inner sides of first and second band 2 and 4. Naturally it is likewise possible to provide further first and second closure elements 10 and 12 that are complementary to one another on the inner sides 6 and 8 of first and second band 2 and 4. The impermeability of the coupling closure 1 can be increased again in this manner. Furthermore, the tops 14 and 16 of first and second bands 2 and 4 possess third and fourth closure elements 18 and 20. A fifth closure element 24 that contributes to the further arresting of a docking device formed from two coupling closures 1 and 1' (not pictured) is attached on the outer side 22 of the first band 2. Its precise mode of operation is subsequently discussed in further detail.

Figure 2:
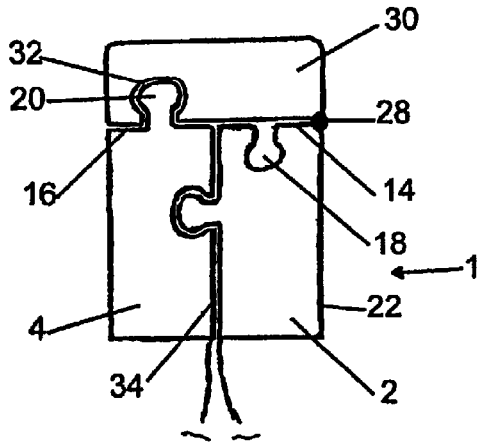
FIG. 2 is a schematic cross-section profile view of an alternative embodiment of a coupling closure.

A schematic cross-section profile view of a coupling closure 1 is shown in FIG. 2 which essentially corresponds to that from FIG. 1, whereby the first band 2 of the coupling closure 1 is connected with a closure cover 30 via an articulation 28. The articulation 28 can, for example, represent a hinge, a sequence of multiple hinges or a film hinge. The articulation 28 is appropriately located in the area of the transition from the top side 14 to the outer side 22 of the first band 2. A sixth closure element 32 is incorporated into the closure cover 30, which sixth closure element 32 is designed in terms of its shape, size and position such that, when the closure cover 30 is placed over the top sides 14 and 16 of first and second band 2 and 4, an arresting interaction occurs with the fourth closure element 20 on the top side 16 of the second band 4. A complementary design in terms of shape and size has also proven to be particularly advantageous with regard to the fourth and sixth closure element 20 and 32. In this way, not only is a slit 34 on the coupling closure 1 completely covered and an even higher degree of environmental impermeability achieved, but rather in addition the interaction between the first and second closure element 10 and 12 on the inner sides 6 and 8, the interaction between the fourth and sixth closure element 20 and 32 also contributes to the state that the inner sides 6 and 8 which situated flush with one another cannot be opened without further measures. Naturally, it is likewise possible to provide a further seventh closure element (not depicted) in the closure cover 30 that corresponds with the third closure element 18 on the top side 14 of the first band 2 and can form an arresting closure.

Figure 3:
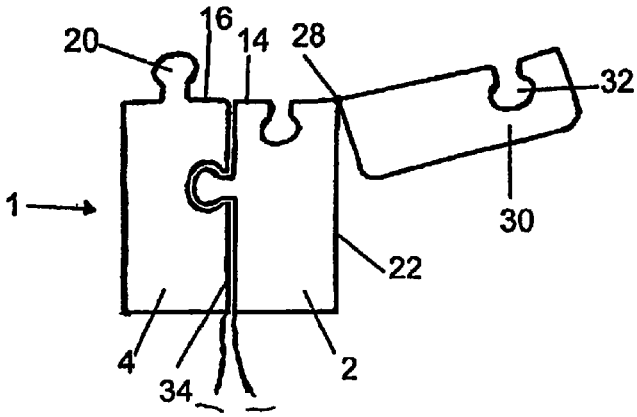
FIG. 3 is a schematic cross-section profile view of a coupling closure according to FIG. 2.
Figure 4:
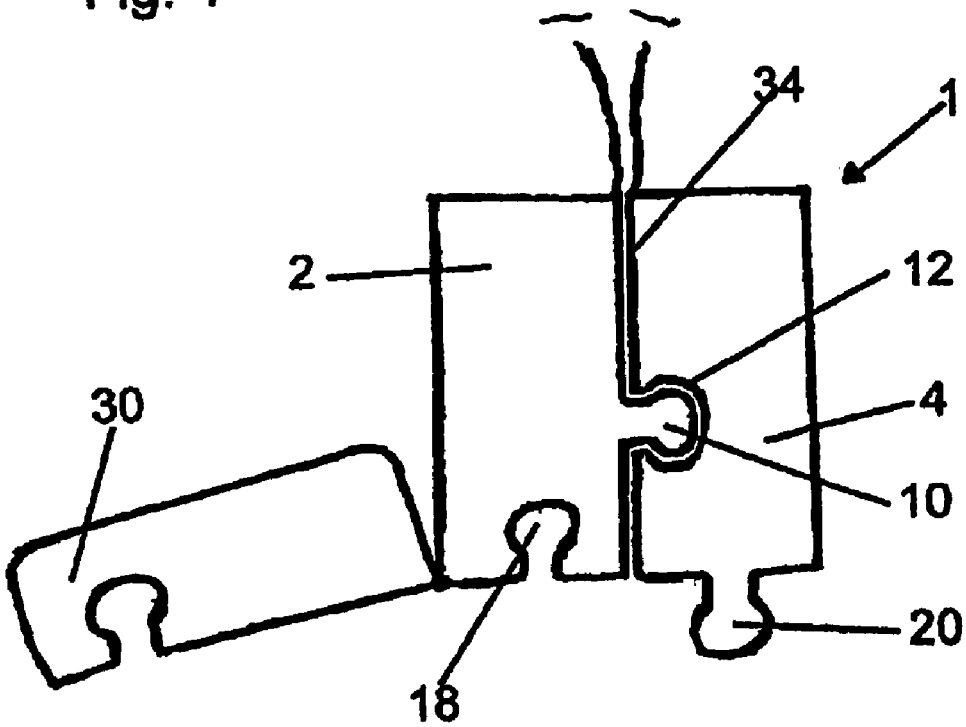
FIG. 4 is a schematic cross-section profile view of two coupling closures.
Figure 4:
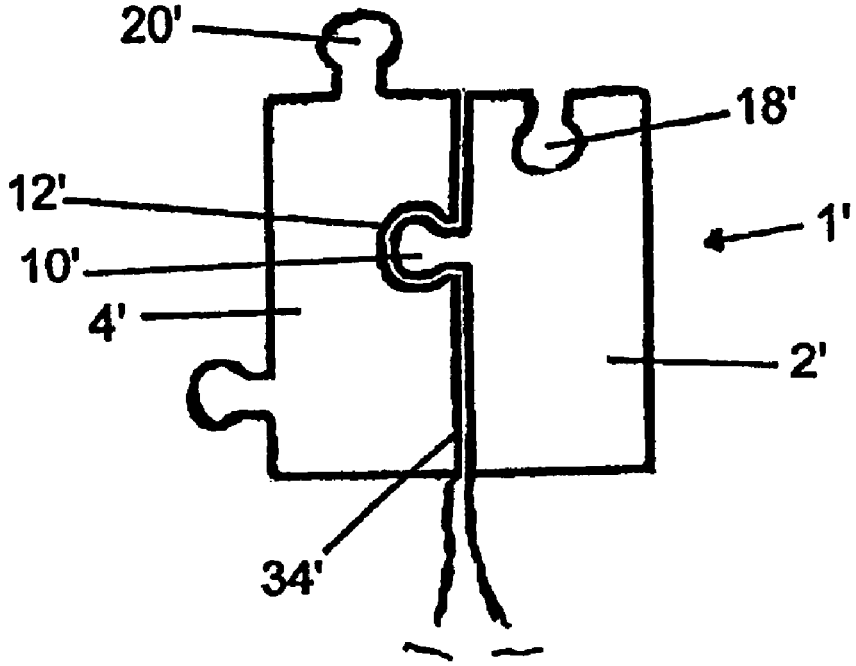
Figure 5:
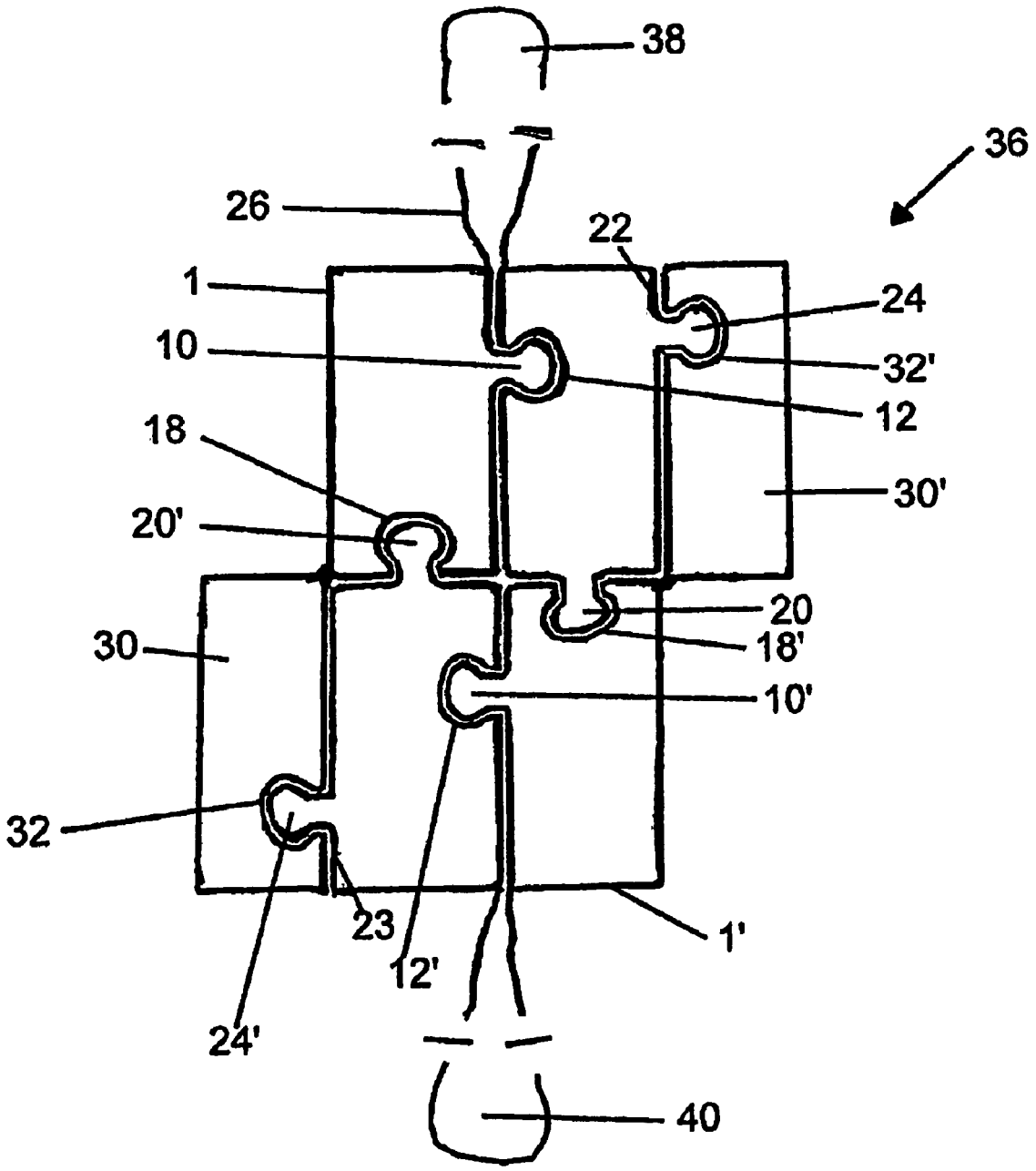
FIG. 5 is a schematic cross-section profile view of a docking device.
Figure 6:
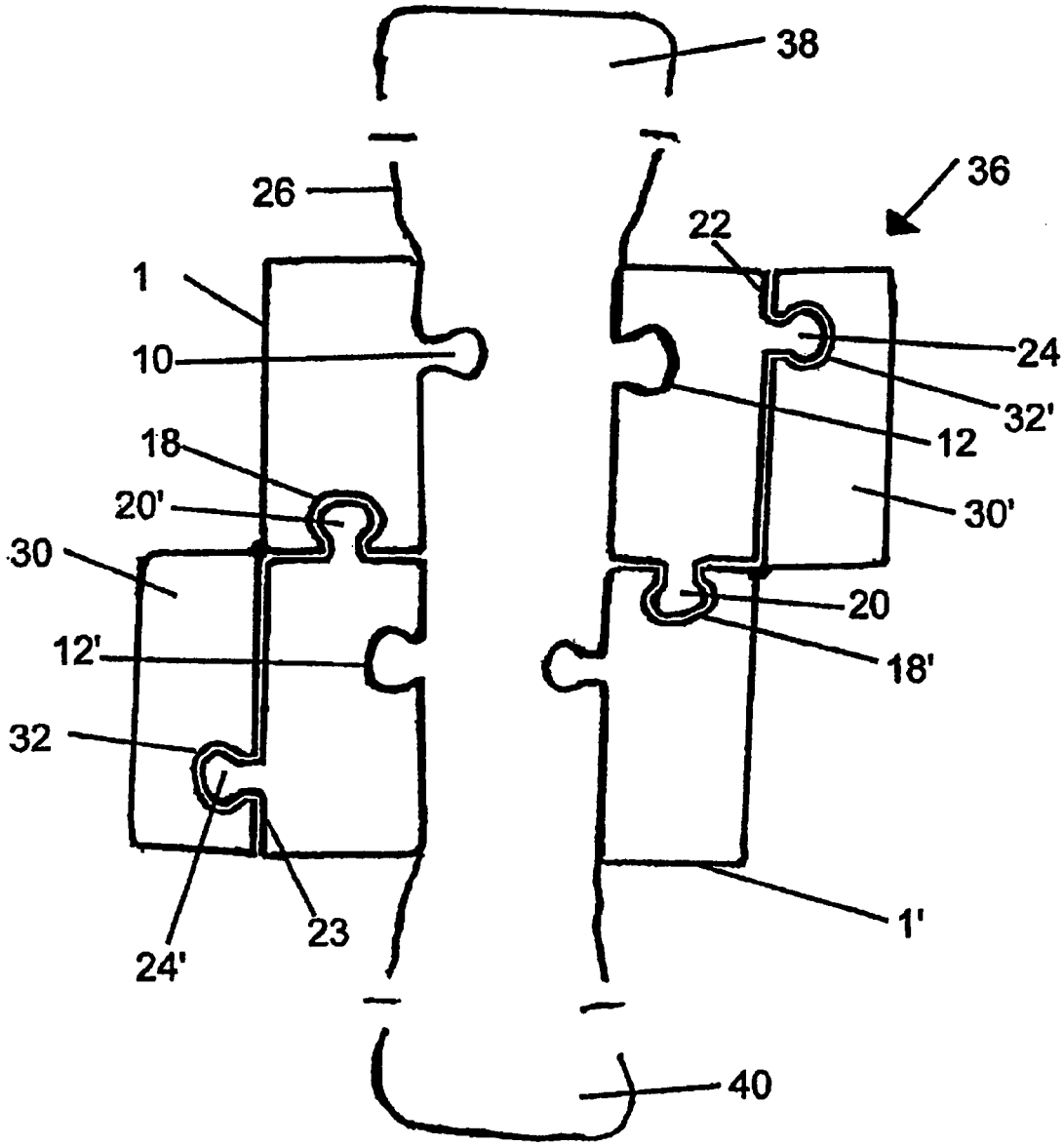
FIG. 6 is a schematic cross-section profile view of a docking device according to FIG. 5.

FIG. 3 shows the embodiment according to FIG. 2 with a folded-up closure cover 30. In this state it is, for example, possible to add a second coupling closure 1' (as shown in FIG. 4) to the first coupling closure 1 in order to form a docking device. The third and fourth closure elements 18' and 20' of the second coupling closure 1' are thereby to be adapted to the third and fourth closure elements 18 and 20 of the first coupling closure 1 in order to achieve the desired locking effect. The third closure element 18 of the first band 2 hereby engages in the fourth closure element 20' of the second band 4' of the coupling closure 1'. The same applies to the closure elements on the second and first band 4 and 2' of first and second coupling closure 1 and 1'. In that the slit 34' of the second coupling closure 1' is also kept closed in an environmentally sealed manner via the interaction of first and second closure element 10' and 12', the first and second coupling closures 1 and 1' can be joined in an unproblematic manner to form a docking device 36 as shown in FIG. 5. The coupling closures 1 and 1' of the docking device 36 according to the embodiment shown in FIG. 5 moreover respectively possess a closure cover 30 and 30' that, in both cases, can be used in order to interact in an arresting manner with the fifth closure or arresting elements 24 and 24' attached on the outer sides 22 and 23. In this way a particularly deep connection between the coupling closures 1 and 1' is produced. This moreover has the advantage that the closure covers 30 and 30' can also be used as handles in order to release the first and second bands of first and second coupling closure 1 and 1' from one another while retaining an environmentally-sealed closure, as shown in FIG. 6. Now bulk material (that, for example, is located in the indicated flexible container 38 that is connected with the coupling closure 1 via the bag edge 26 in an environmentally sealed manner) can be transferred into a second container 40 that is in turn connected with the second coupling closure 1' in an environmentally sealed manner. After the end of the refilling procedure, the first and second coupling closures 1 and 1' are closed again and the coupling closures can be separated from one another.

Figure 7:
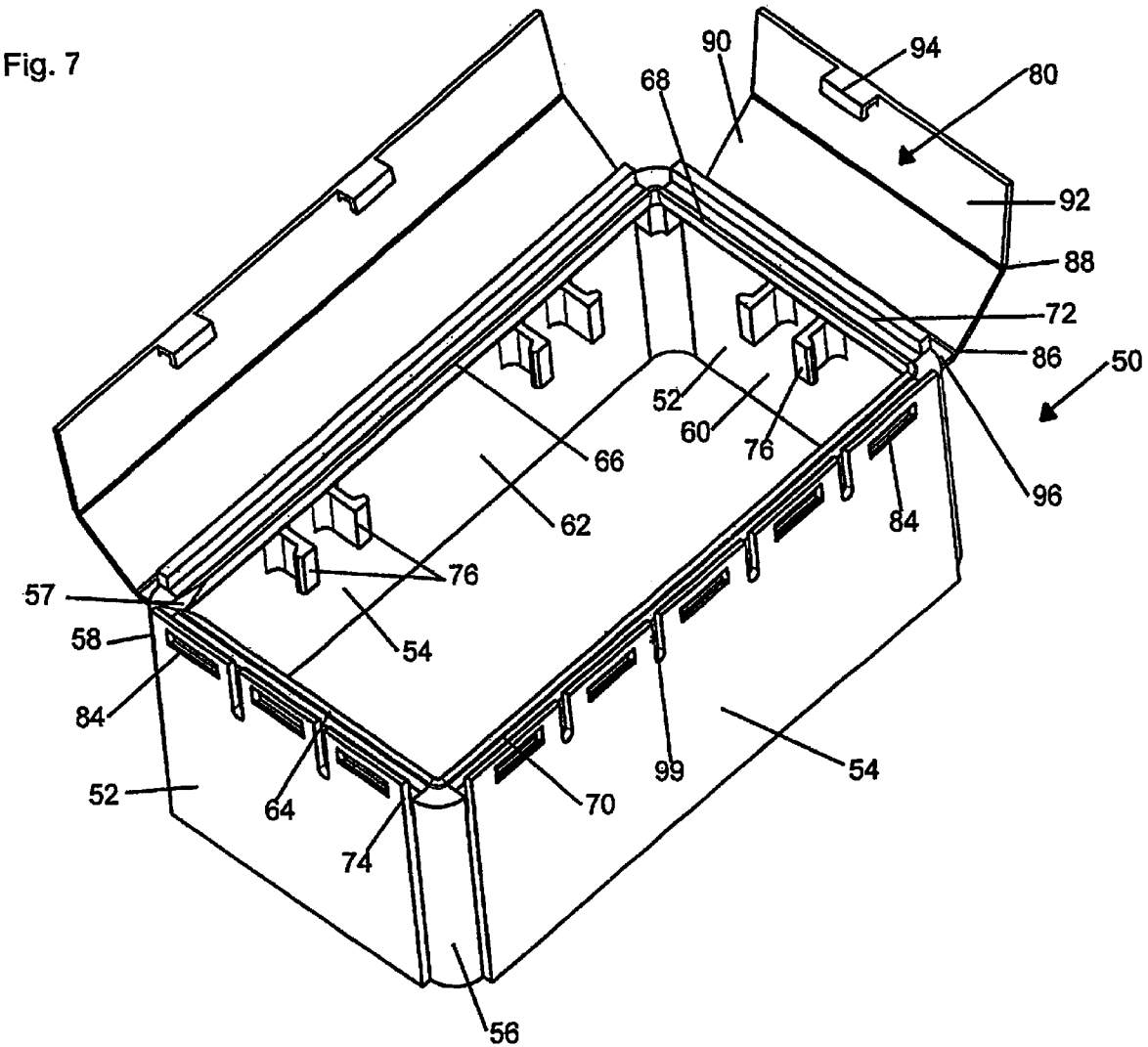
FIG. 7 is a schematic perspective view of a further second coupling closure.

FIG. 7 shows a further, second further development of a coupling closure 50 in the form of what is known as a parallelogram closure. The depicted coupling closure 50 is in total comprised of two narrow frame bands 52 and two longer frame bands 54 as well as of articulation elements 56 (in the form of film hinges) respectively connecting these frame bands. Such a construction can, for example, be achieved in the manner of a two-component injection molding method, whereby thermoplastic elastomers can be used for the film hinges and thermoplastic synthetic materials or duroplasts can be used for the frame bands. In a folding frame 58 constructed in this manner, the degrees of freedom of movement of the individual frame bands 52 and 54 are severely limited. A very large opening cross-section can nevertheless be achieved. The opening cross-section can additionally be arbitrarily varied via reduction or enlargement of the angle of adjacent frame bands 52 and 54. The inner sides 60 and 62 of the frame bands 52 and 54 can thus be placed one atop the other to form a closure without further measures. A particularly high degree of environmental impermeability is achieved in that two closure rails 64 and 66 are attached on the inner sides 60 and 62. These rails advantageously also extend over the inner sides of the articulations 56. It hereby can be a springy-elastic material, for example in the form of bands, that are pressed against one another upon folding the folding frame 58 together. In an appropriate embodiment, the closure rails are made of the same material as the articulations 56. In a further embodiment, first and second closure rails 64 and 66 can also exist as complementarily-shaped closure elements that interlock flush and tight with one another upon folding the folding frame 58 together. For example, a groove construction can be used for the first closure rail 64 and a tongue rail corresponding to this can be used for the second closure rail 66. A particularly high degree of environmental impermeability is also in particular hereby achieved when the first and second closure rails 64 and 66 likewise extend over the inner sides of the (in particular foldable) articulation elements 56.

Insofar as the coupling closures 50 are provided to form a docking device, it is of great advantage when first closure elements 72 are present on the top sides 68 and 70 of the frame bands 52 and 54, which first closure elements 72 are suitable for engaging in a flush and environmentally-sealed manner in corresponding closure elements of a second coupling closure 50' (not shown). Such first closure elements advantageously extend over the entire length of the top side of the frame bands 52 and 54. A particularly high degree of environmental impermeability can be achieved in that a combined groove/tongue construction is provided for these first closure elements.

So that a coupling closure 50 sealed once remains permanently, tightly sealed without external force application or an additional mechanical effort, first arresting elements 76 (for example arresting pins or a pair of adjacent arresting elements 76) are provided on the inner sides of adjacent frame bands 52 and 54, which first arresting elements 76 correspond in terms of shape and size with the first arresting openings 78 or clamping arresting locking openings or pairs of the same that are attached on the inner sides of the remaining two frame bands 52 and 54 of the folding frame 58 and that advantageously correspond to the first arresting elements in terms of shape, size and position. If the coupling closure 50 is closed, these first arresting elements 76 engage in the arresting openings 78 or rails such that the attained closure cannot be released again without application of external force. The position and size of the arresting hooks 76 and arresting openings 78 are advantageously adapted to one another such that, as soon as the arresting elements 76 are engaged, the abutting sides 60 and 62 of the frame bands 52 and 54 or their closure rails 64 and 66 are subjected to a certain pressure.

As is furthermore to be learned from FIG. 7, a closure cover 80 can simultaneously serve as a transport handle. If the inner sides 60 and 62 of the frame bands 52 and 54 are situated next to each other to form a closure slit, the depicted closure cover 80 can be placed over the closure slit and the second arresting element 94 can be engaged in a third arresting opening 84. On the one hand, at least one section of the top side of the coupling closure 50 is hereby covered and protected from contamination, and on the other hand a further closure securing is provided in addition or alternative to the function of first arresting element 76 and the first arresting opening 78. The closure cover or the transport handle 80 is presently connected with the outer side of the frame band 52 or 54 via a retention band 96. This band 96 is normally aligned essentially perpendicular to the outer side and possesses at least one second arresting opening 82. A first handle element 90 that forms a lower handle plate is connected to the band 96 via a first film hinge 86. A second handle element 92 that forms an upper handle plate is connected with the first handle element 90 via a second film hinge 88. In one embodiment, the second handle element 92 can be dimensioned such that a second arresting element 94 located on its outer edge can engage in the second arresting opening 82 as soon as the second handle element 92 is folded onto the first handle element 90.

So that a particularly reliable connection of the coupling closure 50 on a second coupling closure 50' (not shown) arises, temporary closure elements corresponding to one another are attached in the upper region of the frame band 52. Third arresting openings 84 in the form of oblong aperture slits are thus respectively present along the upper edge curve of a narrow side 52 and of a long side 54 of the coupling closure 50. These arresting openings 84 are attached in wall elements which extend over the top sides 68, 70 of the frame bands 52 and 54. A plurality of locking elements 98 are present along the upper section of the remaining frame bands 52 and 54 of the coupling closure 50 that exhibit no openings 84. If two coupling closures 50 and 50' are now coupled with one another, these locking elements 98 engage in corresponding third arresting openings 84' of a second coupling closure 50'. It leads in the same manner to a sealing interaction between the third arresting openings 84 of the first coupling closure 50 and the locking elements 98' of the second coupling closure 50'. It has hereby proven to be advantageous when the wall elements comprising the third arresting openings 84 are separated from one another by material outlets 99 so that a higher degree of flexibility is provided in the locking procedure. These material outlets 99 are naturally designed such that they enable no passage to the inner chamber of the coupling closures and are preferably incorporated into narrow-sided extensions 74 of the frame bands. It is also naturally sufficient when arresting clamping openings 84, 84' are recesses for retaining the locking elements 98, 98', which recesses do not perforate the wall of the frame band.

Figure 8:
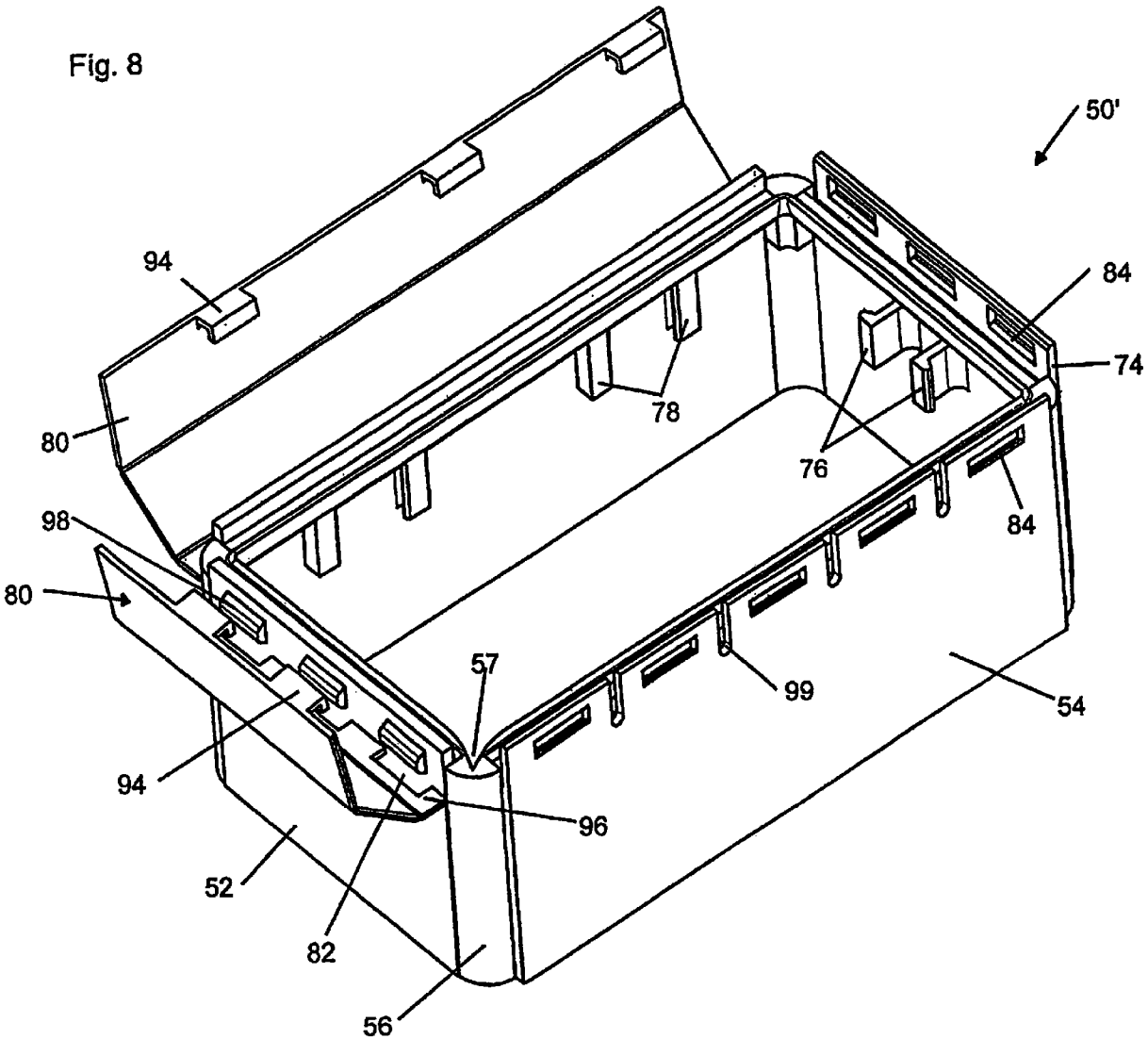
FIG. 8 is a schematic perspective view of an alternative embodiment of a coupling closure according to FIG. 7.

A particularly high degree of environmental impermeability upon closure of the coupling closure 50 is also achieved in that at least two opposite articulations 56 respectively at least partially exhibit at least one notch 57 on their inner sides, in particular in the upper region (i.e. starting from the top side 68, 70 of the frame bands 52, 54). Only one articulation 56 that possesses such a notch 57 is exemplarily, respectively shown in FIGS. 7 and 8. These articulations 56 exhibiting opposite notches 57 are particularly suitable as opposing end sections of a sealed coupling closure 50. Adjacent frame bands 52 and 54 hereby respectively abut one another to form an angle of 0°, while the adjacent articulations 56 that possess no notches connect frame bands 52 and 54 with one another, which frame bands 52 and 54 form an angle of approximately 180° given a sealed coupling closure 50. Via the use of at least two articulations 56 containing at least partial notches 57 on their inner sides, a particularly high degree of impermeability of the closure slit and the coupling closure 50 is ensured, even in the opposing end sections. For the case that two opposing articulations with notches 57 are provided for a coupling closure 50 with four frame bands 52, 54 that are only of equal length in pairs, non-identical coupling closures 50 are normally used in order to form a docking device. Mirror image active and passive shapes are then required for this. Moreover, it is to be noted that degrees of freedom of the folding together of the frame bands 52, 54 are necessarily limited given use of a coupling closure 50 with a pair of articulations containing notches 57; it will be desired to prevent that the opposing articulations without notches form the end sections of the folded coupling closure. A coupling closure 50' is found depicted in FIG. 8 that can be coupled with the coupling closure according to FIG. 7.

Figure 9:
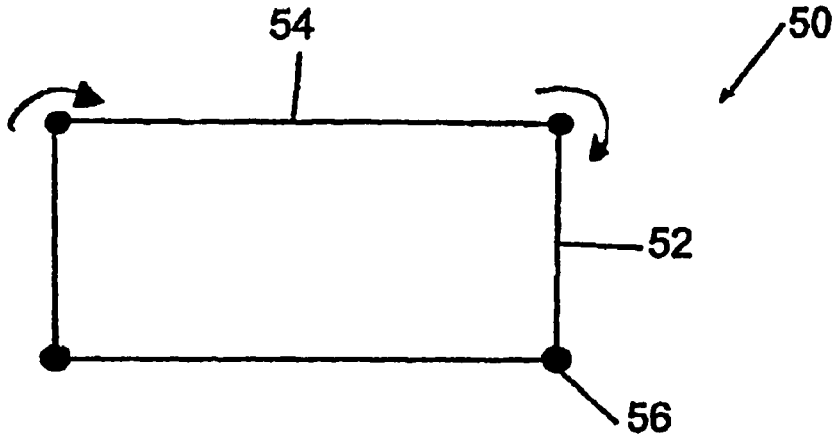
FIG. 9 is a schematic plan view of a coupling closure according to FIG. 7.
Figure 10:
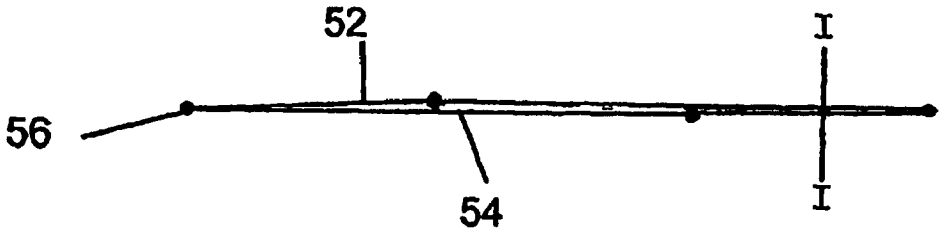
FIG. 10 is a schematic plan view of the coupling closure according to FIG. 7 in a closed state.
Figure 11:
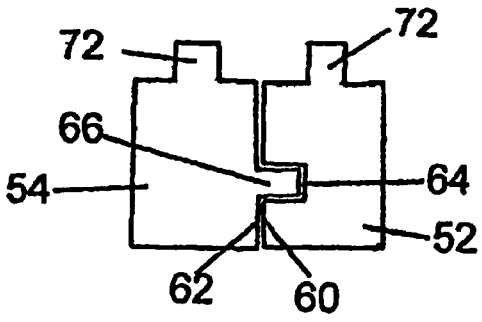
FIG. 11 is a schematic cross-section profile view of the coupling closure according to FIG. 10 along a slice plane I-I.

To be learned from FIG. 9 is the plan view of a coupling closure 50 in a fully opened state. The frame bands 52 and 54 thereby form the shape of a rectangle with the articulation elements 56 in the respective corners. In a closed state, the frame bands 52 and 54 or their inner sides 60 and 62 abut flush with one another, as shown in FIG. 10. Normally only three frame bands are to be moved for a closing of the coupling closure 50. In FIG. 11, a cross-section view of the coupling closure 50 along the slice plane I-I is depicted, in order to show how the first and second closure rails 64 and 66 interlock flush with one another when the frame bands 52 and 54 are folded one atop the other. Moreover, a first closure element 72 is already located on the top sides 68 and 70 of the frame bands 52 and 54.

Figure 12:
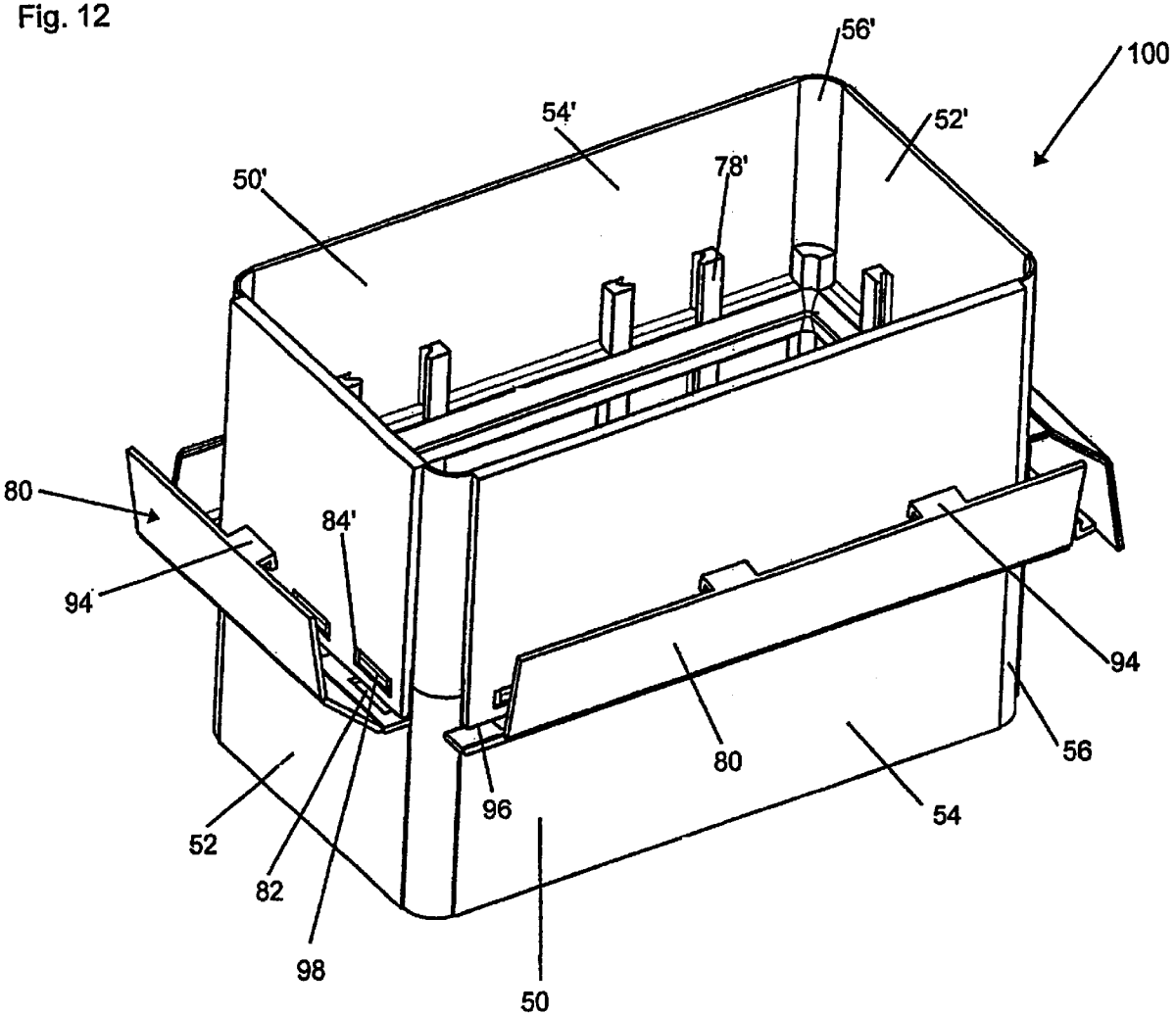
FIG. 12 is a schematic perspective view of a further docking device.

A second further development of a docking device 100 is shown in FIG. 12 that is comprised of two coupling closures 50, 50'. The corresponding first closure elements 72 and 72' on the top sides 68 and 68' of the coupling closures 50, 50' have hereby been interlocked flush with one another to form an environmentally-sealed termination. Among other things, it hereby contributes to this that both coupling closures 50 and 50' are dimensioned essentially identical, in particular with regard to their folding frames 58 and 58'. The transport handles 80 can now be formed by folding first and second handle elements 90 and 92 one atop the other and, if applicable, engaging the second arresting element 94 into the second arresting opening 82. If one designs the handling of the docking device 100 in a particularly advantageous embodiment user-friendly manner, the coupled folding frames can be closed or opened particularly simply via these grips 80. A particularly high degree of impermeability given the coupling of the coupling closures 50 and 50' is also achieved in that the locking elements 98 of the coupling closure 50 engage in the third arresting openings 84' of the coupling closure 50', whereby it is ensured that the docking device 100 does not open without further techniques without external force effect.

Figure 13:
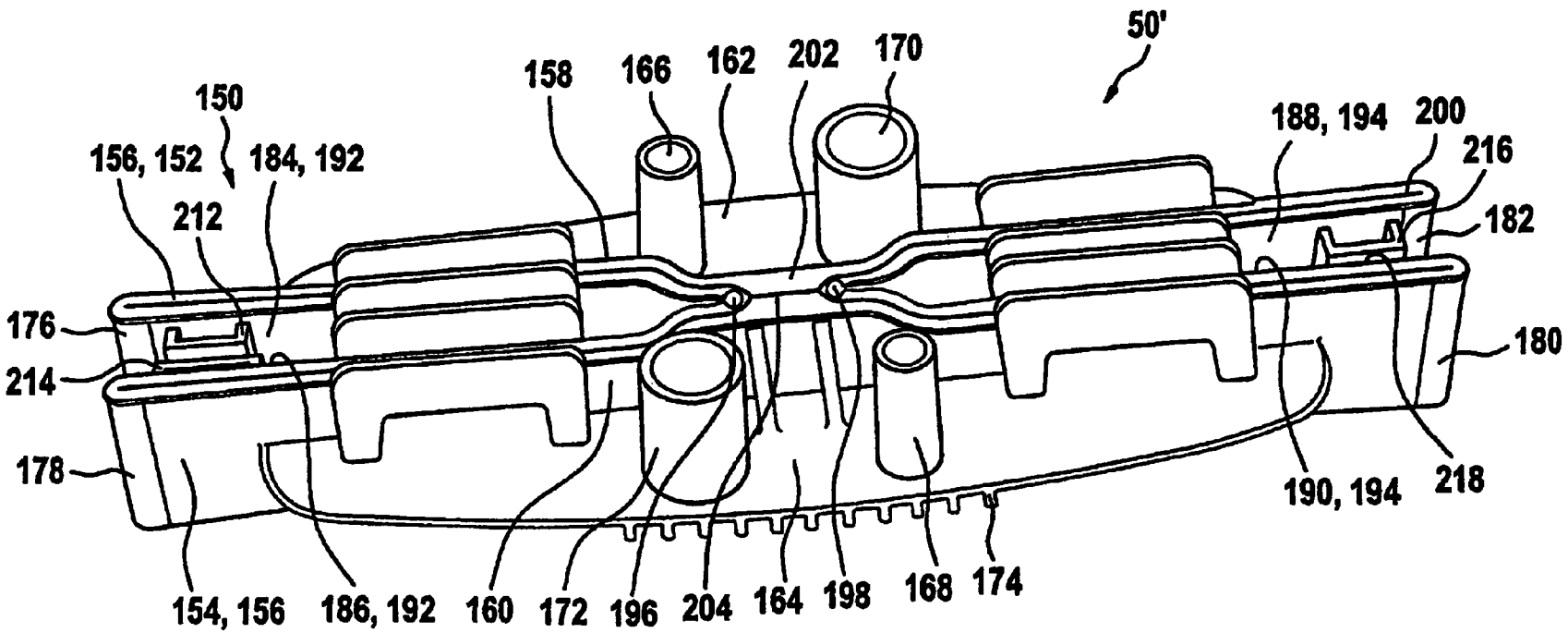
FIG. 13 is a schematic perspective view of an alternative embodiment of a second coupling closure in a closed state.

FIG. 13 shows a perspective view of a further development of a coupling closure 50' according to the second embodiment in a closed state. The coupling closure 50' is shown from the outlet side or underside. The depicted coupling closure 50' possesses two opposing frame bands 152 and 154 that form the third frame band pair 156 and are respectively provided with a control grip 162, 164 on their outer sides 158 and 160. The control grip 162, 164 comprises a centering cone 166, 168 and an arresting collar 170, 172. The centering cone 166, 168 is thereby designed such that it can be introduced into the corresponding arresting collar of a corresponding second coupling closure (not shown). The arresting collar 170, 172 is suitable in the same manner to accept the centering cone of a corresponding second coupling closure (not shown). It is hereby of particular advantage when the inner diameters of the arresting collar or guide rails provided on the inner wall of the same taper away from the opening and/or when the centering cone or the guide rails present on the inner wall of the same widen as they extend away from the tip. In this way, corresponding coupling closures can be docked in a particularly simple and secure manner such that their folding frames or sealing lips automatically reach an attachment in an environmentally-sealed manner. It has proven to be particularly advantageous when both control grips 162, 164 on the outer sides of the frame bands 152, 154 of the third frame band pair 156 comprise the arresting and centering aids described in the preceding. These can comprise transverse ribs 174 to reinforce the control grips 162, 164. The frame bands 152, 154 of the third pair are respectively connected with short frame bands 184, 186 and 188, 190 from the first or second frame band pair 192, 194 via elastic articulation devices 176, 178, 180, 182. As a result, the first frame band 184 of the first frame band pair 192 connects to the first frame band 152 of the third frame band pair 156 via an articulation element 176 at the one end, and the first frame band 188 of the second frame band pair 194 connects to the first frame band 152 of the third frame band pair 156 via an articulation element 182 at the opposite end. In the same way, the respective second frame bands 186 and 190 of the first or second frame band pair 192, 194 are respectively connected with the second frame band 154 of the third frame band pair 156 via an articulation device 178 or 180. A circumferential folding frame 58' is now attained in that the first and second frame bands 184, 186 of the first pair 192 and the first and second frame bands 188, 190 of the second pair 194 are respectively connected with each other via an articulation element 196 or 198. In the present embodiment, the first and second frame bands 184, 186, 188 and 190 of the first and second frame band pair 192, 194 fold inwards upon closing; their respective articulation elements 196 and 198 move towards one another.

A circumferential sealing lip 200 made from elastomeric material which protrudes on the inner side over the cross-section dimensioning of the frame bands has been attached on the edges of the frame bands 152, 154, 184, 186 and 190. If the inner sides of the frame bands 184, 186 or 188, 190 of the first and second pair are to be moved towards the inner sides of the first and second frame bands 153, 154 of the third pair, the sealing lips on the edge curves of the respective frame bands mutually arrive at an attachment and form a tight seal.

In the present embodiment according to FIG. 13, the frame bands 184, 186 and 188, 190 of the first and second pair 192 or 194 are identically dimensioned and possess a length which is shorter than half the length of the frame bands 152, 154 of the third frame band pair 156. Accordingly, the sealing lips 200 of first and second frame band 152, 154 of the third frame pair 156 arrive at an attachment in the middle region of the coupling closure 50'. For this, the contour of first and second frame band 152, 154 of the third pair is respectively provided with a recess 202, 204 in the middle region. The contours of first and second frame band 184, 186, or 188, 190 of the first and second pair are adapted to the contour of the frame bands 152, 154 of the third pair. This contour has the advantage that it forces the folding movement of the first frame bands of first and second pair in the direction of the first frame band of the third pair given movement towards one another of first and second frame band of the third pair. The same applies to the second frame bands of first and second pair in relation to the second frame band of the third pair.

In a closed state, the frame bands 152, 154 of the third pair 156 are held or pressed against one another by suitable arresting or locking closures. In a locked state, the spacers 212, 214 or 216, 218 (present on the outer sides of the frame bands 154, 186 and 188, 190 of the first or second pair) respectively, mutually arrive at an attachment in the region of the articulation devices 176, 178, or 180, 182. These spacers are dimensioned in the manner that the sum of their maximal distances from the base area of the respective frame bands exceeds (in particular slightly) the distance of the outer sides of the first and second frame bands 184, 186 of the first pair 192 or the first and second frame bands 188, 190 of the second pair 194, which outer sides run essentially in parallel and are situated opposite one another. This has the result that, in a closed state (in particular when the first and second frame bands 152, 154 of the third pair 156 are arrested with one another in the middle region) the section on which the first band 184 of the first pair 192 abuts the first band 152 of the third pair 156 and the section on which the second band 186 of the first pair 192 abuts the second band 154 of the third pair 156 are pushed apart using the spring elasticity of the pair of frame bands abutting one another, respectively removed from the middle region of the present, arresting third frame band pair 156. The same effective mechanism is used with the bands 188, 190 of the second pair 194. In this way, the sealing lips 200 of the frame bands (which are already abutting on one another anyway) are pressed even more strongly on one another, in particular in the area of the outer articulation devices 176, 178 and 180, 182.

Figure 14:
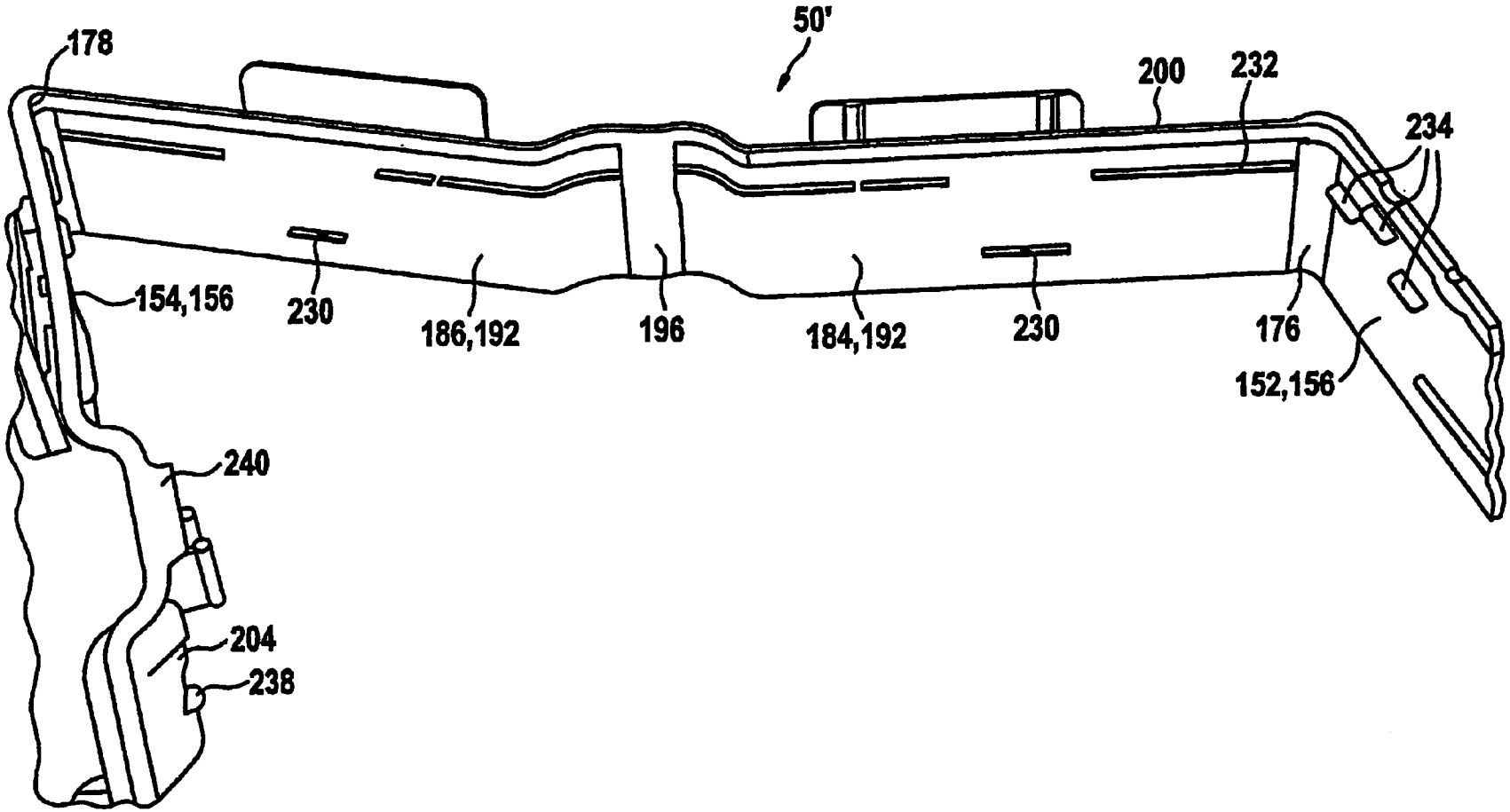
FIG. 14 is a schematic perspective view of the coupling closure according to FIG. 13 in an opened state.

FIG. 14 shows a partial section of a coupling closure 50' according to FIG. 13 in an opened state. The first and second frame bands 184, 186 of the first pair 192 are to be recognized, which first and second frame bands 184, 186 are connected with the first or second frame band 152, 154 of the third pair 156 via articulation devices 176, 178. The inner sides of the first and second frame bands 184, 186 of the first pair 192 comprise spacers 230 (which spacers are respectively approximately central) in the region below the central axis. These have the function to hold the respective frame bands in essentially parallel alignment when brought into attachment with the inner side of the first or second frame band 152, 154 of the third pair 156. Due to the sealing lips extending over the edge on the inner sides, the inner sides of the frame bands normally do not attach over the entire surface. The attachments 238 present below the central axis in the region of the recesses 202, 204 of the first and second band 152, 154 of the third frame band pair take on the same function. The impermeability is increased again with this technique. The inner sides of the frame bands of the first to third frame band pair also possess adjusting elements 232, 234 which can be inserted into one another and take care that the sealing lips 200 of adjacent frame bands (which sealing lips 200 abut one another) are always present at the same level over the entire length in a closed state. For example, strip-shaped protrusions that, when brought into attachment with the inner side of the adjacent frame bars, are accepted on the underside or on the top by corresponding adjustment elements of the opposing inner side represent suitable adjustment elements 232, 234. So that the first and second bands 152, 154 of the third frame band pair 156 (which first and second bands 152, 154 arrive in attachment in the central area) ensure a tight seal, the sealing lip 200 is respectively executed with corresponding sealing tongues 240, 242 (not shown) inwards to an amplified degree beyond the conventional sealing ring curve.

Figure 15:
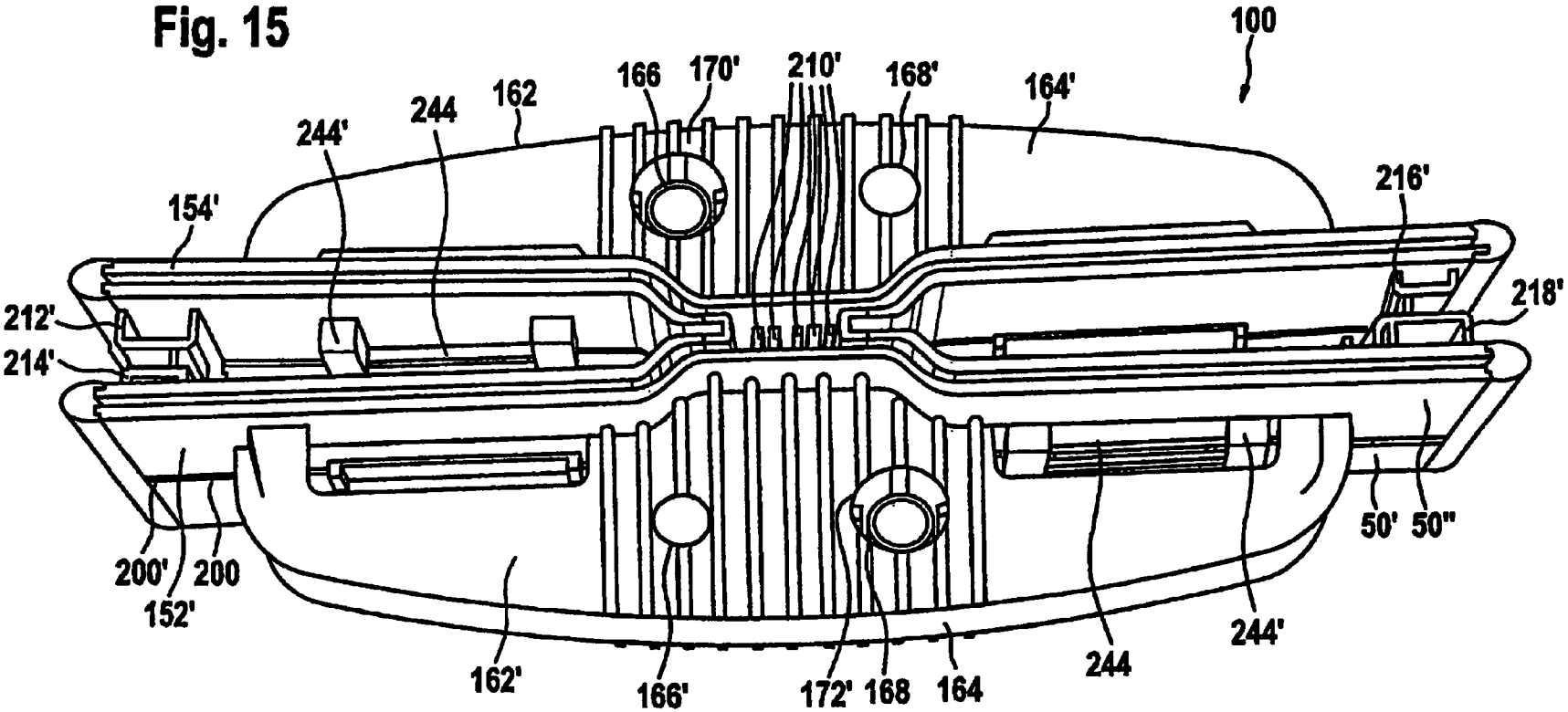
FIG. 15 is a schematic perspective view of a further embodiment of a docking device.

A docking device 100 formed from two identical coupling closures 50', 50" according to FIG. 13 is to be learned from FIG. 15. The first and second frame bands 152', 154' of the third frame band pair of the upper coupling closure are firmly (but detachably) connected with each other via arresting or locking device 210'. The centering cones 166, 168 that are present on the opposing control grips 162, 164 of the lower coupling closure 50' are guided into the arresting collars 170', 172' of the control grips 162', 164' of the upper coupling closure 50". The same applies to the centering cones 166', 168' of the upper coupling closure 50" that are present in the arresting collars 170, 172 of the lower coupling closure 50'. In this way, the circumferential sealing lips 200 and 200' of lower and upper coupling closure 50 and 50' automatically arrive at attachment without further adjustment steps being necessary. The upper and lower coupling closures 50 or 50' are connected with one another to form a docking device 100 by interlocking closure elements 244 and 244' present on the outer sides of the frame bands, which closure elements 244 and 244' reversibly engage in one another.

A flexible container or transport device can either be attached on the outer or inner side along the frame bands of the folding frame 58", for example b means of adhesion or fusing. The docking device 100 according to FIG. 15 can be separated without further techniques when in a closed state. In the same way, the coupling locks 50, 50' forming this docking device can be connected sealed with each other again without further measures. It is also arrived at without further measures to transition the docking device 100 from the closed state to an opened state by pulling apart the first and second frame bands 152, 152', 154, 154' of the third frame band pair 156, 156'.

Figure 16:
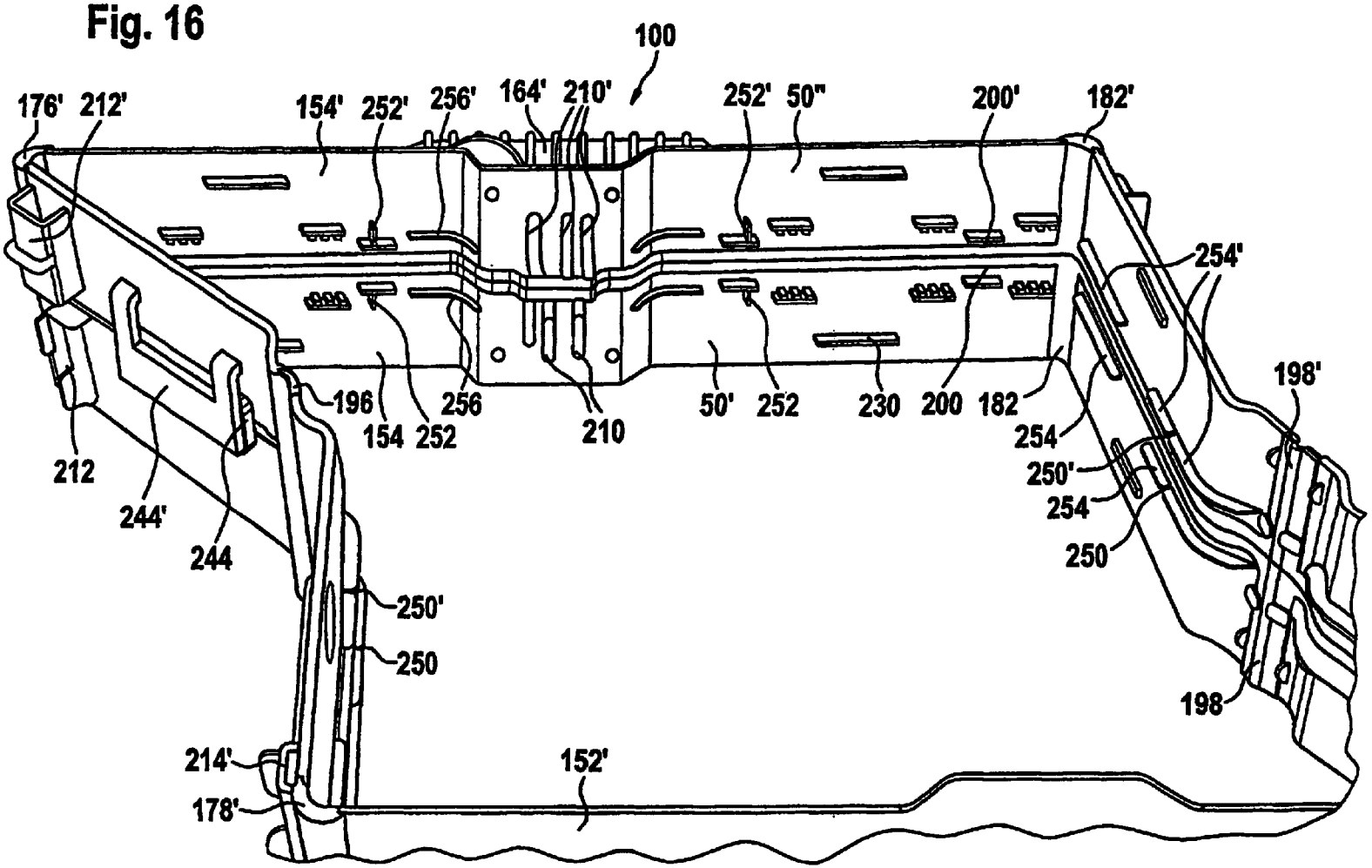
FIG. 16 is a schematic perspective view of a docking device according to FIG. 15 in an opened state.

FIG. 16 shows the docking device according to FIG. 15 in the opened state. The sealing lips 200 and 200' of lower and upper folding frames 58' and 58" are still always fitted sealed with one another. A flexible container or transport device can be connected either on the outside or on the inside along the frame bands of the folding frame 58", for example by means of gluing, fusing, clipping or locked. The docking device 100 according to FIG. 15 can be separated without further measures in the closed state. The coupling closures 50', 50" forming this docking device can be connected sealed with one another again in the same manner without further techniques. It also works without further techniques to transfer the docking device 100 from the sealed state into an opened state via drawing apart the first and second frame bands 152, 152', 154, 154' of the third frame band pairs 156 and 156'.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

We claim as our invention:

1. A coupling closure for substantially environmentally-sealed, reversible closure of containers or hose elements, comprising:

at least one first flexible band with an inner side and at least one first closure element on said inner side, said at least one first closure element comprising a male projection extending outwardly from the inner side or a female cavity extending inwardly from said inner side;

at least one second flexible band with an inner side and at least one second closure element on said inner side that is complementary to the first closure element and enables a reversible, sealed closure, said at least one second closure element comprising a female cavity extending inwardly from the inner side or a male projection extending outwardly from the inner side;

a top side of the first band comprising at least one third closure element and a top side of the second band comprising at least one fourth closure element, said at least one third closure element comprising a male projection extending outwardly from the top side or a female cavity extending inwardly from the top side, and said at least one fourth closure element comprising a male projection extending outwardly from the top side or a female cavity extending inwardly from said the top side; and the first and second bands being of a substantially same length.

2. A coupling closure of claim 1 wherein the first and second bands are connected with one another at respective end segments to form a closed circumference.

3. A coupling closure for substantially environmentally-sealed, reversible closure of containers or hose elements, comprising:

at least one first flexible band with at least one first closure element on its inner side;

at least one second flexible band with at least one second closure element on its inner side that is complementary to the first closure element and enables a reversible, sealed closure;

a top side of the first band comprising at least one third closure element and a top side of the second band comprising at least one fourth closure element; and wherein at least one fifth closure element is provided on at least one outer side of the first or second band.

4. A coupling closure for substantially environmentally-sealed, reversible closure of containers or hose elements, comprising:

at least one first flexible band with at least one first closure element on its inner side;

at least one second flexible band with at least one second closure element on its inner side that is complementary to the first closure element and enables a reversible, sealed closure;

a top side of the first band comprising at least one third closure element and a top side of the second band comprising at least one fourth closure element; and wherein a closure cover is provided comprising: at least one cover closure element that is complementary to the third or fourth closure elements of the top side of the first or second bands, the cover closure element being connectible with the third or fourth closure elements to form a temporary covering of a connection slit of the first and second bands when the inner sides of first and second bands are connected with one another via an interaction of the first and second closure elements.

5. A coupling closure according to claim 4 wherein the closure cover is connected with the first or second bands.

6. A coupling closure according to claim 4 wherein a flexible bag or hose has an opening edge connected with the first and second bands.

7. A coupling closure according to claim 4 wherein at least the inner side or the top side of the first or second bands comprises a bonding or adhesive layer.

8. A docking device for filling or refilling of bulk material, comprising:

first and second coupling closures, each of the coupling closures comprising:

at least one first flexible band with an inner side and at least one first closure element on said inner side, said at least one first closure element comprising a male projection extending outwardly from the inner side or a female cavity extending inwardly from the inner side;

at least one second flexible band with an inner side and at least one second closure element on the inner side that is complementary to the first closure element and enables a reversible, sealed closure, said at least one second closure element comprising a female cavity extending inwardly from the inner side or a male projection extending outwardly from the inner side;

a top side of the first band comprising at least one third closure element and a top side of the second band comprising at least one fourth closure element, said at least one third closure element comprising a male projection extending outwardly from the top side or a female cavity extending inwardly from the top side, and said at least one fourth closure element comprising a male projection extending outwardly from the top side or a female cavity extending inwardly from the top side;

the first and second bands being of a substantially same length; and the third and fourth closure elements of the top sides of the first and second bands of the first coupling closure are complementary to the third and fourth closure elements of the top sides of the first and second bands of the second coupling closure so that the first and second bands of the first and second coupling closures are reversibly connectible with one another.

9. A docking device of claim 8 wherein the first and second coupling closures are for substantially environmentally-sealed reversible closure of containers or hose elements, and the first and second bands are connected with one another with respective end segments.

10. A docking device for filling or refilling of bulk material, comprising:

first and second coupling closures, each of the coupling closures comprising:

at least one first flexible band with at least one first closure element on its inner side, at least one second flexible band with at least one second closure element on its inner side that is complementary to the first closure element and enables a reversible, sealed closure;

a top side of the first band comprising at least one third closure element and a top side of the second band comprising at least one fourth closure element;

the third and fourth closure elements of the top sides of the first and second bands of the first coupling closure are complementary to the third and fourth closure elements of the top sides of the first and second bands of the second coupling closure so that the first and second bands of the first and second coupling closures are reversibly connectible with one another; and wherein at least one fifth closure element is provided on at least one outer side of the first or second band of the first or second coupling closure, the fifth closure element being complementary to a cover closure element of a closure cover of the first or second coupling closure.

11. A docking device according to claim 10 wherein the closure cover of the first coupling closure is reversibly connectible with at least one cover closure element of the second coupling closure, and the closure cover of the second coupling closure is reversibly connectible with at least one cover closure element of the first coupling closure when the third and fourth closure elements of first and second coupling closure are connected with one another.

12. A docking device according to claim 10 wherein the first or second coupling closures are connectible with a flexible container, flexible hose, or hose element.

13. A docking device for filling or refilling of bulk material, comprising:

first and second coupling closures, each of the coupling closures comprising at least one first flexible band with at least one first closure element on its inner side, at least one second flexible band with at least one second closure element on its inner side that is complementary to the first closure element and enables a reversible, sealed closure, a top side of the first band comprising at least one third closure element and a top side of the second band comprising at least one fourth closure element;

the third and fourth closure elements of the top sides of first and second bands of the first coupling closure are complementary to the third and fourth closure elements of the top sides of the first and second bands of the second coupling closure so that the first and second bands of the first and second coupling closures are reversibly connectible with one another; and wherein the first and the second coupling closures are substantially identical.

14. A flexible container system, comprising:

a flexible container; and a coupling closure connected to said flexible container, said coupling closure comprising at least one first flexible band with at least one first closure element on its inner side, at least one second flexible band with at least one second closure element on its inner side which is complementary to the first closure element and enables a reversible, sealed closure, said at least one first closure element comprising a male projection extending outwardly from the inner side or a female cavity extending inwardly from the inner side, and said at least one second closure element comprising a female cavity extending inwardly from the inner side or a male projection extending outwardly from the inner side, and a top side of the first band comprising at least one third closure element and a top side of the second band comprising at least one fourth closure element, said at least one third closure element comprising a male projection extending outwardly from the top side or a female cavity extending inwardly from the top side, and said at least one fourth closure element comprising a female cavity extending inwardly from the top side or a male projection extending outwardly from the top side.

15. A transport device, comprising:

a hose; and a coupling closure for substantially environmentally-sealed reversible closure of said hose, said coupling closure comprising at least one first flexible band having an inner side and at least one first closure element on said inner side, said at least one first closure element comprising a male projection extending outwardly from the inner side or a female cavity extending inwardly from the inner side, at least one second flexible band with an inner side and at least one second closure element on said inner side that is complementary to the first closure element and enables a reversible, sealed closure, said at least one second closure element comprising a female cavity extending inwardly from the inner side or a male projection extending outwardly from the inner side, a top side of the first band comprising at least one third closure element and at a top side of the second band comprising at least one fourth closure element, said at least one third closure element comprising a male projection extending outwardly from the top side or a female cavity extending inwardly from the top side, and said at least one fourth closure element comprising a male projection extending outwardly from the top side or a female cavity extending inwardly from the top side; and the first and second bands being of a substantially same length.

16. A method for filling, refilling, or emptying of flexible containers, comprising the steps:

providing a docking device comprising first and second coupling closures, each of the first and second coupling closures comprising at least one flexible band with at least one first closure element on its inner side, at least one second flexible band with at least one second closure element on its inner side that is complementary to the first closure element and enables a reversible, seal closure, said at least one first closure element comprising a male projection extending outwardly from the inner side or a female cavity extending inwardly from the inner side, and said at least one second closure element comprising a female cavity extending inwardly from the inner side or a male projection extending outwardly from the inner side, and a top side of the first band comprising at least one third closure element and a top side of the second band comprising at least one fourth closure element, said at least one third closure element comprising a male projection extending outwardly from the top side or a female cavity extending inwardly from the top side, and said at least one fourth closure element comprising a male cavity extending outwardly from the top side or a female cavity extending inwardly from the top side, and wherein the third and fourth closure elements of the top sides of the first and second bands of the first coupling closure are complementary to the third and fourth closure elements with the top sides with the first and second bands of the second coupling closure so that the first and second bands of the first and second coupling closures are reversibly connectible with one another;

connecting a first flexible container with a second flexible container with the first and second coupling closures of said docking device;

opening the first and second coupling closures while maintaining the docking device environmentally-sealed;

transporting bulk material from the first container into the second container or vice versa;

closing the first and second coupling closures in an environmentally-sealed manner while maintaining the docking device environmentally-sealed; and separating the first coupling closure connected to the first container and the second coupling closure connected to the second container from one another upon decoupling of the docking device.

* * * * *